US012054798B2

(12) United States Patent
Arai et al.

(10) Patent No.: US 12,054,798 B2
(45) Date of Patent: Aug. 6, 2024

(54) STEEL MATERIAL AND METHOD FOR PRODUCING STEEL MATERIAL

(71) Applicant: NIPPON STEEL CORPORATION, Tokyo (JP)

(72) Inventors: Yuji Arai, Tokyo (JP); Shinji Yoshida, Tokyo (JP); Hiroki Kamitani, Tokyo (JP); Yohei Otome, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 579 days.

(21) Appl. No.: 17/265,614

(22) PCT Filed: Oct. 16, 2019

(86) PCT No.: PCT/JP2019/040725

§ 371 (c)(1),
(2) Date: Feb. 3, 2021

(87) PCT Pub. No.: WO2020/090478

PCT Pub. Date: May 7, 2020

(65) Prior Publication Data

US 2021/0262051 A1 Aug. 26, 2021

(30) Foreign Application Priority Data

Oct. 31, 2018 (JP) ..... 2018-205533
Oct. 31, 2018 (JP) ..... 2018-205604

(51) Int. Cl.
*C21D 8/10* (2006.01)
*C21D 6/00* (2006.01)
(Continued)

(52) U.S. Cl.
CPC ..... *C21D 8/105* (2013.01); *C21D 6/004* (2013.01); *C21D 6/005* (2013.01); *C21D 6/007* (2013.01);
(Continued)

(58) Field of Classification Search
CPC ..... C21D 8/105; C21D 6/004; C21D 6/005; C21D 6/007; C21D 6/008; C21D 9/085;
(Continued)

(56) References Cited

U.S. PATENT DOCUMENTS

2007/0137736 A1 6/2007 Omura et al.
2011/0315276 A1 12/2011 Bosch et al.
2019/0062862 A1* 2/2019 Nakata ..... C22C 38/02

FOREIGN PATENT DOCUMENTS

JP 59232220 A 12/1984
JP 62253720 A 11/1987
(Continued)

*Primary Examiner* — Anthony M Liang
*Assistant Examiner* — Danny N Kang
(74) *Attorney, Agent, or Firm* — Greer, Burns & Crain, Ltd.

(57) ABSTRACT

The steel material according to the present disclosure has a chemical composition consisting of, in mass %, C: 0.15 to 0.45%, Si: 0.05 to 1.00%, Mn: 0.01 to 1.00%, P: 0.030% or less, S: 0.0050% or less, Al: 0.005 to 0.100%, Cr 0.60 to 1.80%, Mo: 0.80 to 2.30%, Ti: 0.002 to 0.020%, V: 0.05 to 0.30%, Nb: 0.002 to 0.100%, B: 0.0005 to 0.0040%, Cu: 0.01 to 0.50%, Ni: 0.01 to 0.50%, N: 0.0020 to 0.0100% and O: 0.0020% or less, with the balance being Fe and impurities. The number density of BN in the steel material is 10 to 100 particles/100 μm$^2$. The yield strength of the steel material is 758 MPa or more.

7 Claims, 3 Drawing Sheets

(51) Int. Cl.

| | |
|---|---|
| ***C21D 9/00*** | (2006.01) |
| ***C21D 9/08*** | (2006.01) |
| ***C22C 38/00*** | (2006.01) |
| ***C22C 38/44*** | (2006.01) |
| ***C22C 38/46*** | (2006.01) |
| ***C22C 38/54*** | (2006.01) |

(52) U.S. Cl.
CPC ..... *C21D 6/008* (2013.01); *C21D 9/085* (2013.01); *C22C 38/001* (2013.01); *C22C 38/44* (2013.01); *C22C 38/46* (2013.01); *C22C 38/54* (2013.01)

(58) Field of Classification Search
CPC ..... C21D 2211/002; C21D 1/18; C21D 1/26; C21D 2211/004; C21D 2211/008; C22C 38/001; C22C 38/44; C22C 38/46; C22C 38/54; C22C 38/002; C22C 38/005; C22C 38/02; C22C 38/04; C22C 38/42; C22C 38/48; C22C 38/50; C22C 38/52
See application file for complete search history.

(56) References Cited

FOREIGN PATENT DOCUMENTS

| | | | |
|---|---|---|---|
| JP | 06322478 | A | 11/1994 |
| JP | 08311551 | A | 11/1996 |
| JP | 2000256783 | A | 9/2000 |
| JP | 2000297344 | A | 10/2000 |
| JP | 2005350754 | A | 12/2005 |
| JP | 2012026030 | A | 2/2012 |
| JP | 2012519238 | A | 8/2012 |

* cited by examiner

STEEL MATERIAL AND METHOD FOR PRODUCING STEEL MATERIAL

This is a National Phase Application filed under 35 U.S.C. § 371, of International Application No. PCT/JP2019/040725, filed Oct. 16, 2019, the contents of which are incorporated by reference.

TECHNICAL FIELD

The present invention relates to a steel material and a method for producing the steel material, and more particularly relates to a steel material suitable for use in a sour environment, and a method for producing the steel material.

BACKGROUND ART

Due to the deepening of oil wells and gas wells (hereunder, oil wells and gas wells are collectively referred to as "oil wells"), there is a demand to enhance the strength of oil-well steel material represented by oil-well steel pipes. Specifically, 80 ksi grade (yield strength is 80 to less than 95 ksi, that is, 552 to less than 655 MPa) and 95 ksi grade (yield strength is 95 to less than 110 ksi, that is, 655 to less than 758 MPa) oil-well steel pipes are being widely utilized, and recently requests are also starting to be made for 110 ksi grade (yield strength is 110 to less than 125 ksi, that is, 758 to less than 862 MPa) and 125 ksi or more (yield strength is 862 MPa or more) oil-well steel pipes.

Most deep wells are in a sour environment containing corrosive hydrogen sulfide. In the present description, the term "sour environment" means an environment which contains hydrogen sulfide and is acidified. Note that a sour environment may contain carbon dioxide. Oil-well steel pipes for use in such sour environments are required to have not only high strength, but to also have sulfide stress cracking resistance (hereunder, referred to as "SSC resistance").

Technology for enhancing the SSC resistance of steel materials as typified by oil-well steel pipes is disclosed in Japanese Patent Application Publication No. 62-253720 (Patent Literature 1). Japanese Patent Application Publication No. 59-232220 (Patent Literature 2) Japanese Patent Application Publication No. 6-322478 (Patent Literature 3), Japanese Patent Application Publication No. 8-311551 (Patent Literature 4), Japanese Patent Application Publication No. 2000-256783 (Patent Literature 5), Japanese Patent Application Publication No. 2000-297344 (Patent Literature 6), Japanese Patent Application Publication No. 2005-350754 (Patent Literature 7), National Publication of International Patent Application No. 2012-519238 (Patent Literature 8) and Japanese Patent Application Publication No. 2012-26030 (Patent Literature 9).

Patent Literature 1 proposes a method for improving the SSC resistance of steel for oil wells by reducing impurities such as Mn and P. Patent Literature 2 proposes a method for improving the SSC resistance of steel by performing quenching twice to refine the grains.

Patent Literature 3 proposes a method for improving the SSC resistance of a 125 ksi grade steel material by refining the steel microstructure by a heat treatment using induction heating. Patent Literature 4 proposes a method for improving the SSC resistance of steel pipes of 110 to 140 ksi grade by enhancing the hardenability of the steel by utilizing a direct quenching process and also increasing the tempering temperature.

Patent Literature 5 and Patent Literature 6 each propose a method for improving the SSC resistance of a steel for low-alloy oil country tubular goods of 110 to 140 ksi grade by controlling the shapes of carbides. Patent Literature 7 proposes a method for improving the SSC resistance of steel materials of 125 ksi grade or higher by controlling the dislocation density and the hydrogen diffusion coefficient to desired values. Patent Literature 8 proposes a method for improving the SSC resistance of steel of 125 ksi grade by subjecting a low-alloy steel containing 0.3 to 0.5% of C to quenching multiple times. Patent Literature 9 proposes a method for controlling the shapes or number of carbides by employing a tempering process composed of a two-stage heat treatment. More specifically, in Patent Literature 9, a method is proposed that enhances the SSC resistance of 125 ksi grade steel by suppressing the number density of large $M_3C$ particles or $M_2C$ particles.

CITATION LIST

Patent Literature

Patent Literature 1: Japanese Patent Application Publication No. 62-253720

Patent Literature 2: Japanese Patent Application Publication No. 59-232220

Patent Literature 3: Japanese Patent Application Publication No. 6-322478

Patent Literature 4: Japanese Patent Application Publication No. 8-311551

Patent Literature 5: Japanese Patent Application Publication No. 2000-256783

Patent Literature 6: Japanese Patent Application Publication No. 2000-297344

Patent Literature 7: Japanese Patent Application Publication No. 2005-350754

Patent Literature 8: National Publication of International Patent Application No. 2012-519238

Patent Literature 9: Japanese Patent Application Publication No. 2012-26030

SUMMARY OF INVENTION

Technical Problem

However, a steel material (e.g., oil-well steel pipe) having a yield strength of 110 ksi or more (758 MPa or more) and excellent SSC resistance may be obtained by a technique other than the techniques disclosed in the above Patent Literature 1 to 9.

An objective of the present disclosure is to provide a steel material having a yield strength of 758 MPa or more (110 ksi or more) and having excellent SSC resistance, as well as a method for producing the steel material.

Solution to Problem

The steel material according to the present disclosure has a chemical composition consisting of, in mass %, C: 0.15 to 0.45%, Si: 0.05 to 1.00%, Mn: 0.01 to 1.00%, P: 0.030% or less, S: 0.0050% or less, Al: 0.005 to 0.100%, Cr: 0.60 to 1.80%. Mo: 0.80 to 2.30%, Ti: 0.002 to 0.020%, V: 0.05 to 0.30%, Nb: 0.002 to 0.100%. B: 0.0005 to 0.0040%, Cu: 0.01 to 0.50%, Ni: 0.01 to 0.50%, N: 0.0020 to 0.0100%, O: 0.0020% or less, Ca: 0 to 0.0100%, Mg: 0 to 0.0100%, Zr: 0 to 0.0100%, rare earth metal: 0 to 0.0100%, Co: 0 to 0.50%, and W: 0 to 0.50%, with the balance being Fe and impurities. In the steel material, the number density of BN is 10 to 100 particles/100 $\mu m^2$. The yield strength of the steel material is 758 MPa or more.

The method for producing a steel material according to the present disclosure includes a preparation process, a quenching process, and a tempering process. In the preparation process, an intermediate steel material having the above described chemical composition is prepared. In the quenching process, after the preparation process, the intermediate steel material is heated to a quenching temperature of 880 to 1000° C., and thereafter the intermediate steel material is cooled for 60 to 300 seconds from the quenching temperature to a rapid cooling starting temperature within a range of an $A_{r3}$ point of the steel material to an $A_{c3}$ point of the steel material −10° C., and thereafter is cooled from the rapid cooling starting temperature at a cooling rate of 50° C./min or more. In the tempering process, after the quenching process, the intermediate steel material is held at 620 to 720° C. for 10 to 180 minutes.

Advantageous Effects of Invention

The steel material according to the present disclosure has a yield strength of 758 MPa or more (110 ksi or more), and also has excellent SSC resistance. The method for producing a steel material according to the present disclosure can produce the above described steel material.

DESCRIPTION OF EMBODIMENTS

Figure 1A:
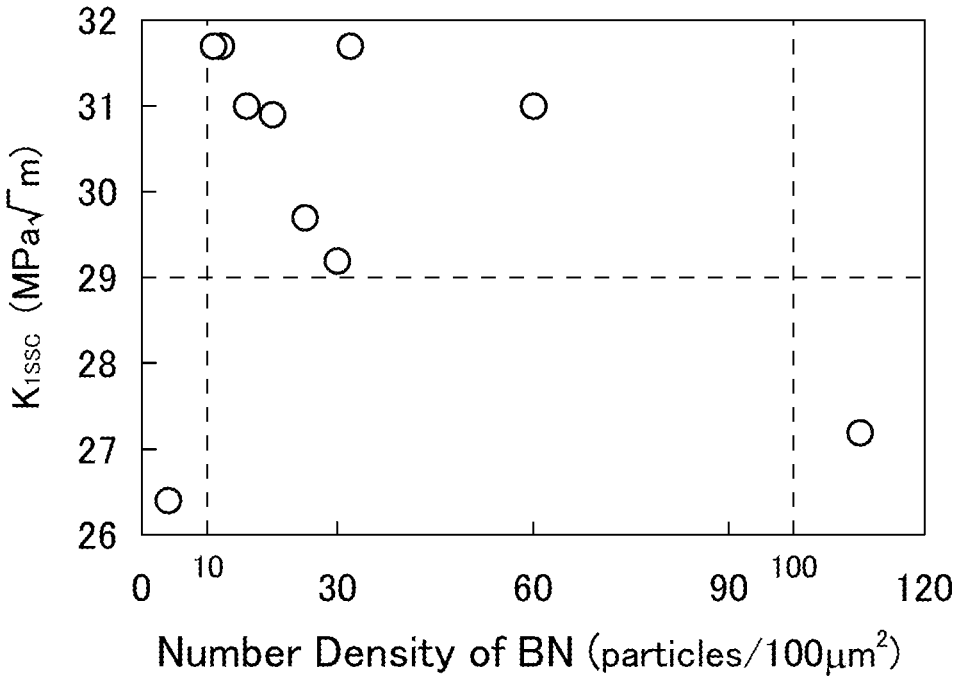
FIG. 1A is a view illustrating the relation between the number density of BN and the SSC resistance for the steel materials having a yield strength of 110 ksi grade.

The present inventors conducted investigations and studies regarding a method for obtaining excellent SSC resistance while maintaining a yield strength of 758 MPa or more (110 ksi or more) with respect to a steel material that will assumedly be used in a sour environment, and obtained the following findings.

If the dislocation density in a steel material is increased, the yield strength of the steel material will increase. However, there is possibility that dislocations will occlude hydrogen. Therefore, if the dislocation density in a steel material increases, there is a possibility that the amount of hydrogen that the steel material occludes will also increase. If the hydrogen concentration in the steel material increases as a result of increasing the dislocation density, even if high strength is obtained, the SSC resistance of the steel material will decrease. Accordingly, in order to obtain both a yield strength of 110 ksi or more and excellent SSC resistance, utilizing the dislocation density to enhance the strength is not preferable.

Therefore, the present inventors considered that, if the yield strength of a steel material is increased by a different technique other than increasing the dislocation density of the steel material, excellent SSC resistance will be obtained even if the yield strength of the steel material is increased to 110 ksi or more. Thus, the present inventors focused on elements that increase temper softening resistance, and considered that increasing the content of such elements will increase the yield strength of the steel material after tempering. Specifically, the present inventors conducted studies regarding increasing the yield strength of a steel material by, among the elements of the chemical composition of the steel material, making the Cr content 0.60% or more, the Mo content 0.80% or more, and the V content 0.05% or more.

That is, the present inventors discovered that by making the chemical composition of a steel material a composition consisting of, in mass %, C: 0.15 to 0.45%, Si: 0.05 to 1.00%, Mn: 0.01 to 1.00%, P: 0.030% or less, S: 0.0050% or less, Al; 0.005 to 0.100%, Cr: 0.60 to 1.80%. Mo: 0.80 to 2.30%, Ti: 0.002 to 0.020%, V: 0.05 to 0.30%, Nb: 0.002 to 0.100%, B: 0.0005 to 0.0040%, Cu: 0.01 to 0.50%, Ni: 0.01 to 0.50%. N: 0.0020 to 0.0100%, O: 0.0020% or less, Ca: 0 to 0.0100%. Mg: 0 to 0.0100%, Zr: 0 to 0.0100%, rare earth metal: 0 to 0.0100%. Co: 0 to 0.50%, and W: 0 to 0.50%, with the balance being Fe and impurities, because the temper softening resistance of the steel material increases and the yield strength of the steel material after tempering increases, there is a possibility of obtaining excellent SSC resistance in a sour environment even when the steel material has a yield strength of 110 ksi or more.

However, in the case of a steel material having the chemical composition described above, in some cases a large number of coarse precipitates may precipitate in the steel material. As a result of further studies conducted by the present inventors, it was clarified that, in a steel material having the aforementioned chemical composition, in a case where a large number of coarse precipitates precipitate in the steel material, excellent SSC resistance is not obtained in a sour environment.

That is, with respect to a steel material having the aforementioned chemical composition, if coarse precipitates are reduced there is a possibility that both a yield strength of 758 MPa or more (110 ksi or more) and excellent SSC resistance in a sour environment can be obtained. Therefore, the present inventors conducted studies regarding a method for reducing coarse precipitates in a steel material having the aforementioned chemical composition.

First, the present inventors found that most coarse precipitates precipitate at the grain boundaries of prior-austenite grains (hereunder, prior-austenite grains are also referred to as "prior-γ grains"; and grain boundaries of prior-austenite grains are also referred to as "prior-γ grain boundaries"), and precipitate during tempering that is described later. That is, if fine precipitates that have little influence on SSC resistance are caused to precipitate at prior-γ grain boundaries before performing tempering, the sites at which coarse precipitates form are reduced, and there is thus a possibility that coarse precipitates can be reduced in the steel material after tempering, and the SSC resistance of the steel material in a sour environment can be increased.

Therefore, the present inventors conducted studies regarding elements that are liable to segregate at prior-γ grain boundaries and are liable to form fine precipitates at a high temperature. As a result, the present inventors discovered that there is a possibility that these conditions can be satisfied by boron nitride (BN) that boron (B) forms. Therefore, the present inventors focused on B among the elements of the above-mentioned chemical composition, and conducted detailed studies regarding actively causing BN to precipitate to thereby reduce precipitation of coarse precipitates and increase the SSC resistance of the steel material. Specifically, using a steel material having the above-mentioned chemical composition, the present inventors investigated the relation between the number density of BN, the yield strength, and a fracture toughness value $K_{ISSC}$ that is an index of SSC resistance.

[Relation Between Number Density of BN and SSC Resistance]

The present inventors first conducted detailed studies regarding the relation between the number density of BN and SSC resistance of a steel material having a yield strength of 110 ksi grade (758 to less than 862 MPa). Specifically, with reference to the figures, the relation between the number density of BN and SSC resistance of the steel material containing aforementioned chemical composition and a yield strength of 110 ksi grade is described.

FIG. 1A is a view illustrating the relation between the number density of BN and the SSC resistance of a steel material having a yield strength of 110 ksi grade. FIG. 1A was created using number densities (particles/100 $\mu m^2$) of BN obtained by a method that is described later and fracture toughness values $K_{ISSC}$ (MPa√m) obtained by a DCB test that is described later, with respect to steel materials for which, among the steel materials of the examples that are described later, having the aforementioned chemical composition and having the yield strength of 110 ksi grade. Note that, with respect to the SSC resistance, when the fracture toughness value $K_{ISSC}$ was 29.0 MPa√m or more, it was determined that the SSC resistance was good.

Referring to FIG. 1A, in a steel material having the aforementioned chemical composition and the yield strength of 110 ksi grade, when the number density of BN was 10 particles/100 $\mu m^2$ or more, the fracture toughness value $K_{ISSC}$ was 29.0 MPa√m or more and the steel material exhibited excellent SSC resistance. On the other hand, in a steel material having the aforementioned chemical composition and the yield strength of 110 ksi grade, when the number density of BN was more than 100 particles/100 $\mu m^2$, the fracture toughness value $K_{ISSC}$ was less than 29.0 MPa√m. That is, in a case where the number density of BN was too high, conversely, the SSC resistance decreased.

Therefore, referring to FIG. 1A, in a steel material having the aforementioned chemical composition and the yield strength of 110 ksi grade, it was clarified that when the number density of BN is 10 to 100 particles/100 $\mu m^2$, the fracture toughness value $K_{ISSC}$ is 29.0 MPa√m or more and the steel material exhibited excellent SSC resistance.

The present inventors further conducted detailed studies regarding the relation between the number density of BN and SSC resistance of a steel material having a yield strength of 125 ksi or more (862 MPa or more). Specifically, with reference to the figures, the relation between the number density of BN and SSC resistance of the steel material containing aforementioned chemical composition and a yield strength of 125 ksi or more is described.

Figure 1B:
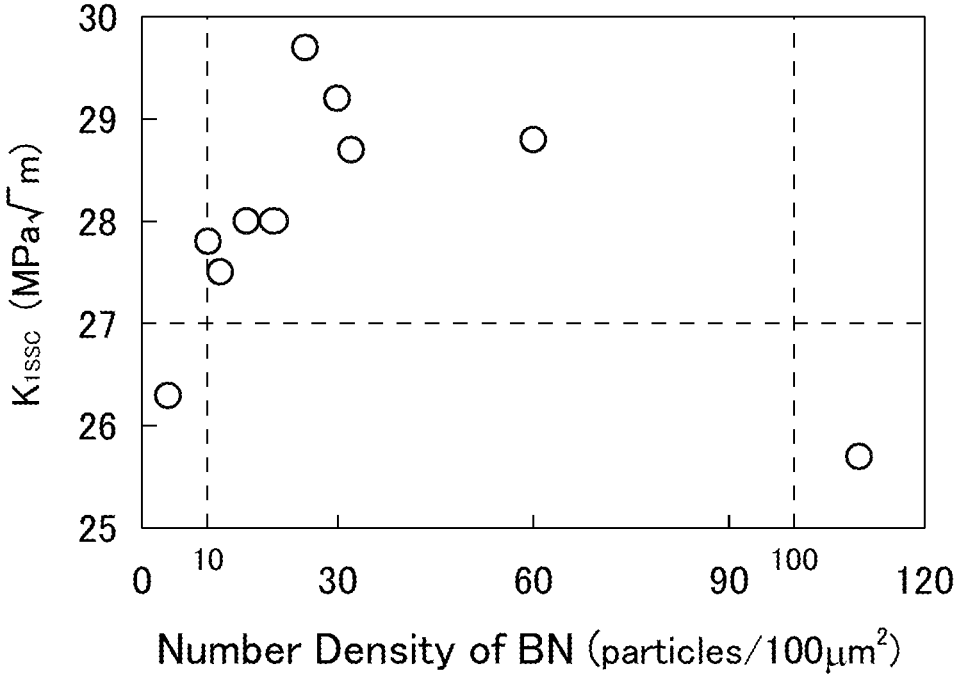
FIG. 1B is a view illustrating the relation between the number density of BN and the SSC resistance for the steel materials having a yield strength of 125 ksi or more.

FIG. 1B is a view illustrating the relation between the number density of BN and the SSC resistance of a steel material having a yield strength of 125 ksi or more. FIG. 1B was created using number densities (particles/100 $m^2$) of BN obtained by a method that is described later and fracture toughness values $K_{ISSC}$ (MPa√m) obtained by a DCB test that is described later, with respect to steel materials for which, among the steel materials of the examples that are described later, having the aforementioned chemical composition and having the yield strength of 125 ksi or more. Note that, with respect to the SSC resistance, when the fracture toughness value $K_{ISSC}$ was 27.0 MPa√m or more, it was determined that the SSC resistance was good.

Referring to FIG. 1B, in a steel material having the aforementioned chemical composition and the yield strength of 125 ksi or more, when the number density of BN was 10 particles/100 $\mu m^2$ or more, the fracture toughness value $K_{ISSC}$ was 27.0 MPa√m or more and the steel material exhibited excellent SSC resistance. On the other hand, in a steel material having the aforementioned chemical composition and the yield strength of 125 ksi or more, when the number density of BN was more than 100 particles/100 $\mu m^2$, the fracture toughness value $K_{ISSC}$ was less than 27.0 MPa√m. That is, in a case where the number density of BN was too high, conversely, the SSC resistance decreased.

Therefore, referring to FIG. 1B, in a steel material having the aforementioned chemical composition and the yield strength of 125 ksi or more, it was clarified that when the number density of BN is within a range of 10 to 100 particles/100 $\mu m^2$, the fracture toughness value $K_{ISSC}$ is 27.0 MPa√m or more and the steel material exhibited excellent SSC resistance.

Note that, with regard to the relation between the number density of BN and SSC resistance of a steel material, the present inventors consider that the reason may be as follows. Conventionally. B is contained in a steel material for the purpose of causing the B to dissolve in the steel material to thereby increase the hardenability of the steel material. On the other hand, B is liable to segregate at prior-γ grain boundaries and, in the temperature range of the $A_{r3}$ point to less than the $A_{c3}$ point of the steel material according to the present embodiment, combines with N to form BN. Therefore, in the present embodiment, rather than causing B to dissolve in the steel material as is conventionally done, by causing B to instead precipitate as BN, sites at which coarse precipitates form can be reduced in advance prior to tempering. The present inventors consider that, as a result, coarse precipitates in the steel material are reduced and the SSC resistance of the steel material thus increases.

As described above, if a steel material has the above-mentioned chemical composition and the number density of BN is in the range of 10 to 100 particles/100 $\mu m^2$, even when a yield strength is 758 MPa or more (110 ksi or more), excellent SSC resistance can be obtained. Therefore, in the steel material according to the present embodiment, the number density of BN is set within the range of 10 to 100 particles/100 $\mu m^2$.

The steel material according to the present embodiment that was completed based on the above findings has a chemical composition consisting of, in mass %. C: 0.15 to 0.45%, Si: 0.05 to 1.00%, Mn: 0.01 to 1.00%, P: 0.030/o or less, S: 0.0050% or less, Al: 0.005 to 0.100%, Cr: 0.60 to 1.80%, Mo: 0.80 to 2.30%, Ti: 0.002 to 0.020%. V: 0.05 to 0.30%, Nb: 0.002 to 0.100%, B: 0.0005 to 0.0040%, Cu: 0.01 to 0.50%, Ni: 0.01 to 0.50%, N: 0.0020 to 0.0100%, O: 0.0020% or less, Ca: 0 to 0.0100%, Mg: 0 to 0.0100%, Zr: 0 to 0.0100%, rare earth metal: 0 to 0.0100%, Co: 0 to 0.50%, and W: 0 to 0.50%, with the balance being Fe and impurities. The number density of BN in the steel material is in the range of 10 to 100 particles/100 $\mu m^2$. The yield strength of the steel material is 758 MPa or more.

In the present description, the term "steel material" is not particularly limited, and for example refers to a steel pipe or a steel plate.

The steel material according to the present embodiment has a yield strength of 758 MPa or more (110 ksi or more), and exhibits excellent SSC resistance in a sour environment.

The aforementioned chemical composition may contain one or more types of element selected from the group consisting of Ca: 0.0001 to 0.0100%. Mg: 0.0001 to 0.0100%, Zr: 0.0001 to 0.0100% and rare earth metal: 0.0001 to 0.0100%.

The aforementioned chemical composition may contain one or more types of element selected from the group consisting of Co: 0.02 to 0.50% and W: 0.02 to 0.50%.

The aforementioned steel material may be an oil-well steel pipe.

In the present description, the oil-well steel pipe may be a steel pipe that is used for a line pipe or may be a steel pipe used for oil country tubular goods (OCTG). The shape of the oil-well steel pipe is not particularly limited and may be, for example, a seamless steel pipe or a welded steel pipe. The oil country tubular goods are, for example, steel pipes that are used as casing pipes or tubing pipes.

The oil-well steel pipe according to the present embodiment is preferably a seamless steel pipe. When the oil-well steel pipe according to the present embodiment is a seamless steel pipe, even if the diameter of prior-γ grains (hereunder, also referred to as "prior-γ grain diameter") is in the range of 15 to 30 μm, both a yield strength of 758 MPa or more (110 ksi or more) and excellent SSC resistance can be obtained.

The method for producing a steel material according to the present embodiment includes a preparation process, a quenching process and a tempering process. In the preparation process, an intermediate steel material having the aforementioned chemical composition is prepared. In the quenching process, after the preparation process, the intermediate steel material is heated to a quenching temperature of 880 to 1000° C., and thereafter the intermediate steel material is cooled for 60 to 300 seconds from the quenching temperature to a rapid cooling starting temperature within a range of an $A_{r3}$ point of the steel material to an $A_{c3}$ point of the steel material −10° C., and thereafter is cooled from the rapid cooling starting temperature at a cooling rate of 50° C./min or more. In the tempering process, after the quenching process, the intermediate steel material is held at 620 to 720° C. for 10 to 180 minutes.

The preparation process of the production method mentioned above may include a starting material preparation process of preparing a starting material containing the aforementioned chemical composition, and a hot working process of subjecting the starting material to hot working to produce the intermediate steel material.

Hereunder, the steel material according to the present embodiment is described in detail. The symbol "%" in relation to an element means "mass percent" unless specifically stated otherwise.

[Chemical Composition]

The chemical composition of the steel material according to the present embodiment contains the following elements.

C: 0.15 to 0.45%

Carbon (C) enhances the hardenability of the steel material and increases the yield strength of the steel material. C also promotes spheroidization of carbides during tempering in the production process, and increases the SSC resistance of the steel material. If the carbides are dispersed, the strength of the steel material increases further. These effects will not be obtained if the C content is too low. On the other hand, if the C content is too high, the toughness of the steel material will decrease and quench cracking is liable to occur. Therefore, the C content is within the range of 0.15 to 0.45%. A preferable lower limit of the C content is 0.18%, more preferably is 0.20%, and further preferably is 0.25%. A preferable upper limit of the C content is 0.40%, more preferably is 0.38%, and further preferably is 0.35%.

Si: 0.05 to 1.00%

Silicon (Si) deoxidizes steel. If the Si content is too low, this effect is not obtained. On the other hand, if the Si content is too high, the SSC resistance of the steel material decreases. Therefore, the Si content is within the range of 0.05 to 1.00%. A preferable lower limit of the Si content is 0.10%, and more preferably is 0.15%. A preferable upper limit of the Si content is 0.85%, more preferably is 0.70%, and further preferably is 0.60%.

Mn: 0.01 to 1.000%

Manganese (Mn) deoxidizes steel. Mn also enhances the hardenability of the steel material and increases the yield strength of the steel material. If the Mn content is too low, these effects are not obtained. On the other hand, if the Mn content is too high, Mn segregates at grain boundaries together with impurities such as P and S. In such a case, the SSC resistance of the steel material will decrease. Therefore, the Mn content is within a range of 0.01 to 0.00/o. A preferable lower limit of the Mn content is 0.02%, more preferably is 0.03%, and further preferably is 0.10%. A preferable upper limit of the Mn content is 0.900%, and more preferably is 0.80%.

P: 0.030% or Less

Phosphorous (P) is an impurity. In other words, the P content is more than 0%. P segregates at the grain boundaries and decreases the SSC resistance of the steel material. Therefore, the P content is 0.030% or less. A preferable upper limit of the P content is 0.025%, and more preferably is 0.020%. Preferably, the P content is as low as possible. However, if the P content is excessively reduced, the production cost increases significantly. Therefore, when taking industrial production into consideration, a preferable lower limit of the P content is 0.0001%, more preferably is 0.0003%, further preferably is 0.001%, and further preferably is 0.002%.

S: 0.0050% or Less

Sulfur (S) is an impurity. In other words, the S content is more than 0%. S segregates at the grain boundaries and decreases the SSC resistance of the steel material. Therefore, the S content is 0.0050% or less. A preferable upper limit of the S content is 0.0040%, more preferably is 0.0030%, and further preferably is 0.0020%. Preferably, the S content is as low as possible. However, if the S content is excessively reduced, the production cost increases significantly. Therefore, when taking industrial production into consideration, a preferable lower limit of the S content is 0.0001%, and more preferably is 0.0003%.

Al: 0.005 to 0.100%

Aluminum (Al) deoxidizes steel. If the Al content is too low, this effect is not obtained and the SSC resistance of the steel material decreases. On the other hand, if the Al content is too high, coarse oxide-based inclusions are formed and the SSC resistance of the steel material decreases. Therefore, the Al content is within a range of 0.005 to 0.100%. A preferable lower limit of the Al content is 0.015%, and more preferably is 0.020%. A preferable upper limit of the Al content is 0.080%, and more preferably is 0.060%. In the present description, the "Al" content means "acid-soluble Al", that is, the content of "sol. Al".

Cr: 0.60 to 1.80%

Chromium (Cr) increases temper softening resistance, and increases the yield strength of the steel material. When the temper softening resistance of the steel material is increased by Cr, high-temperature tempering is also enabled. In this case, the SSC resistance of the steel material increases. If the Cr content is too low, these effects are not obtained. On the other hand, if the Cr content is too high, coarse carbides form in the steel material and the SSC resistance of the steel material decreases. Therefore, the Cr content is within a range of 0.60 to 1.80%. A preferable lower limit of the Cr content is 0.65%, more preferably is 0.70%, and further preferably is 0.75%. A preferable upper limit of the Cr content is 1.60%, more preferably is 1.55%, and further preferably is 1.50%.

Mo: 0.80 to 2.30%

Molybdenum (Mo) increases temper softening resistance, and increases the yield strength of the steel material. When the temper softening resistance of the steel material is increased by Mo, high-temperature tempering is also enabled. In this case, the SSC resistance of the steel material increases. If the Mo content is too low, these effects are not obtained. On the other hand, if the Mo content is too high, $Mo_6C$-type carbides are not dissolved by heating prior to quenching, and remain in the steel material. As a result, the hardenability of the steel material decreases and the SSC resistance of the steel material decreases. Therefore, the Mo content is within a range of 0.80 to 2.30%. A preferable lower limit of the Mo content is 0.85%, and more preferably is 0.90%. A preferable upper limit of the Mo content is 2.10%, and more preferably is 1.80%.

Ti: 0.002 to 0.020%

Titanium (Ti) forms nitrides, and refines crystal grains by the pinning effect. By this means, the yield strength of the steel material increases. If the Ti content is too low, this effect is not obtained. On the other hand, if the Ti content is too high, a large amount of Ti nitrides are formed, and reduce precipitation of BN. As a result, the SSC resistance of the steel material decreases. Therefore, the Ti content is within a range of 0.002 to 0.020%. A preferable lower limit of the Ti content is 0.003%, and more preferably is 0.004%. A preferable upper limit of the Ti content is 0.018%, and more preferably is 0.015%.

V: 0.05 to 0.30%.

Vanadium (V) combines with C to form carbides, and increases temper softening resistance by an effect of precipitation strengthening. As a result, the yield strength of the steel material increases. When the temper softening resistance of the steel material is increased by V, high-temperature tempering is also enabled. In this case, the SSC resistance of the steel material increases. If the V content is too low, these effects are not obtained. On the other hand, if the V content is too high, the toughness of the steel material decreases. Therefore, the V content is within the range of 0.05 to 0.30%. A preferable lower limit of the V content is more than 0.05%, more preferably is 0.06%, and further preferably is 0.07%. A preferable upper limit of the V content is 0.25%, more preferably is 0.20%, and further preferably is 0.15%.

Nb: 0.002 to 0.100%

Niobium (Nb) combines with C and/or N to form carbides, nitrides or carbo-nitrides (hereinafter, referred to as "carbo-nitrides and the like"). The carbo-nitrides and the like refine the substructure of the steel material by the pinning effect, and improve the SSC resistance of the steel material. Nb also combines with C to form fine carbides. As a result, the yield strength of the steel material increases. If the Nb content is too low, these effects are not obtained. On the other hand, if the Nb content is too high, carbo-nitrides and the like are excessively formed and the SSC resistance of the steel material decreases. Therefore, the Nb content is within the range of 0.002 to 0.100%. A preferable lower limit of the Nb content is 0.003%, more preferably is 0.005%, and further preferably is 0.010%. A preferable upper limit of the Nb content is 0.050%, and more preferably is 0.030%.

B: 0.0005 to 0.0040%

Boron (B) combines with N to form BN in the steel material. As a result, precipitation of coarse precipitates that precipitate at prior-γ grain boundaries is reduced. B also dissolves in the steel material and enhances the hardenability of the steel material. In the steel material of the present embodiment, among these effects, the SSC resistance of the steel material is increased by actively causing BN to precipitate. If the B content is too low, this effect is not obtained. On the other hand, if the B content is too high, a large amount of BN will be formed in the steel material and the SSC resistance of the steel material may decrease. In addition, if the B content is too high, course BN may be formed in the steel material and the SSC resistance of the steel material may decrease. Therefore, the B content is within a range of 0.0005 to 0.0040%. A preferable lower limit of the B content is 0.0007%, more preferably is 0.0010%, and further preferably is 0.0012%. A preferable upper limit of the B content is 0.0035%, more preferably is 0.0030%, and further preferably is 0.0025%.

Cu: 0.01 to 0.50%

Copper (Cu) enhances the hardenability of the steel material, and increases the yield strength of the steel material. If the Cu content is too low, this effect is not obtained. On the other hand, if the Cu content is too high, the hardenability of the steel material will be too high and the SSC resistance of the steel material will decrease. Therefore, the Cu content is in a range of 0.01 to 0.50%. A preferable lower limit of the Cu content is 0.02%. A preferable upper limit of the Cu content is 0.40%, more preferably is 0.30%, further preferably is 0.20%, and further preferably is 0.15%.

Ni: 0.01 to 0.50%

Nickel (Ni) enhances the hardenability of the steel material, and increases the yield strength of the steel material. If the Ni content is too low, this effect is not obtained. On the other hand, if the Ni content is too high, the Ni will promote local corrosion and the SSC resistance of the steel material will decrease. Therefore, the Ni content is within the range of 0.01 to 0.50%. A preferable lower limit of the Ni content is 0.02%. A preferable upper limit of the Ni content is 0.40%, more preferably is 0.30%, further preferably is 0.20%, and further preferably is 0.15%.

N: 0.0020 to 0.0100%

Nitrogen (N) combines with B to form BN in the steel material. As a result, coarse precipitates that precipitate at prior-γ grain boundaries are reduced. N also combines with Ti to form fine nitrides and thereby refines crystal grains. If the N content is too low, these effects are not obtained. On the other hand, if the N content is too high, a large amount of BN may be formed in the steel material and the SSC resistance of the steel material may decrease. In addition, if the N content is too high, course BN may be formed in the steel material and the SSC resistance of the steel material may decrease. Therefore, the N content is within the range of 0.0020 to 0.0100%. A preferable lower limit of the N content is 0.0025%, more preferably is 0.0030%, further preferably is 0.0035%, and further preferably is 0.0040%. A preferable upper limit of the N content is 0.0080%, and more preferably is 0.0070%.

O: 0.0020% or Less

Oxygen (O) is an impurity. In other words, the O content is more than 0%. O forms coarse oxides and reduces the corrosion resistance of the steel material. Therefore, the O content is 0.0020% or less. A preferable upper limit of the O content is 0.0018%, and more preferably is 0.0015%. Preferably, the O content is as low as possible. However, if the O content is excessively reduced, the production cost increases significantly. Therefore, when taking industrial production into consideration, a preferable lower limit of the O content is 0.0001%, and more preferably is 0.0003%.

The balance of the chemical composition of the steel material according to the present embodiment is Fe and impurities. Here, the term "impurities" refers to elements which, during industrial production of the steel material, are mixed in from ore or scrap that is used as a raw material of the steel material, or from the production environment or the like, and which are allowed within a range that does not adversely affect the steel material according to the present embodiment.

[Regarding Optional Elements]

The chemical composition of the steel material described above may further contain one or more types of element selected from the group consisting of Ca, Mg, Zr and rare earth metal (REM) in lieu of a part of Fe. Each of these elements is an optional element, and controls the morphology of sulfides in the steel material to thereby increase the SSC resistance of the steel material.

Ca: 0 to 0.0100%

Calcium (Ca) is an optional element, and need not be contained. In other words, the Ca content may be 0%. If contained, Ca renders S in the steel material harmless by forming sulfides, and increases the SSC resistance of the steel material. If even a small amount of Ca is contained, this effect is obtained to a certain extent. However, if the Ca content is too high, oxides in the steel material coarsen and the SSC resistance of the steel material decreases. Therefore, the Ca content is within the range of 0 to 0.0100%. A preferable lower limit of the Ca content is more than 0%, more preferably is 0.0001%, further preferably is 0.0003%, and further preferably is 0.0006%. A preferable upper limit of the Ca content is 0.0040%, more preferably is 0.0030%, and further preferably is 0.0025%.

Mg: 0 to 0.0100%

Magnesium (Mg) is an optional element, and need not be contained. In other words, the Mg content may be 0%. If contained, Mg renders S in the steel material harmless by forming sulfides, and increases the SSC resistance of the steel material. If even a small amount of Mg is contained, this effect is obtained to a certain extent. However, if the Mg content is too high, oxides in the steel material coarsen and the SSC resistance of the steel material decreases. Therefore, the Mg content is within the range of 0 to 0.0100%. A preferable lower limit of the Mg content is more than 0%, more preferably is 0.0001%, further preferably is 0.0003%, and further preferably is 0.0006%. A preferable upper limit of the Mg content is 0.0040%, more preferably is 0.0030%, and further preferably is 0.0025%.

Zr: 0 to 0.0100%

Zirconium (Zr) is an optional element, and need not be contained. In other words, the Zr content may be 0%. If contained, Zr renders S in the steel material harmless by forming sulfides, and increases the SSC resistance of the steel material. If even a small amount of Zr is contained, this effect is obtained to a certain extent. However, if the Zr content is too high, oxides in the steel material coarsen and the SSC resistance of the steel material decreases. Therefore, the Zr content is within the range of 0 to 0.0100%. A preferable lower limit of the Zr content is more than 0%, more preferably is 0.0001%, further preferably is 0.0003%, and further preferably is 0.0006%. A preferable upper limit of the Zr content is 0.0040%, more preferably is 0.0030%, and further preferably is 0.0025%.

Rare Earth Metal (REM): 0 to 0.0100%

Rare earth metal (REM) is an optional element, and need not be contained. In other words, the REM content may be 0%. If contained, REM renders S in the steel material harmless by forming sulfides, and increases the SSC resistance of the steel material. REM also combines with P in the steel material and suppresses segregation of P at the crystal grain boundaries. Therefore, a decrease in low-temperature toughness and in the SSC resistance of the steel material that is attributable to segregation of P is suppressed. If even a small amount of REM is contained, these effects are obtained to a certain extent. However, if the REM content is too high, oxides coarsen and the low-temperature toughness and SSC resistance of the steel material decrease. Therefore, the REM content is within the range of 0 to 0.0100%. A preferable lower limit of the REM content is more than 0%, more preferably is 0.0001%, further preferably is 0.0003%, and further preferably is 0.0006%. A preferable upper limit of the REM content is 0.0040%, and more preferably is 0.0025%.

Note that, in the present description the term "REM" refers to one or more types of element selected from a group consisting of scandium (Sc) which is the element with atomic number 21, yttrium (Y) which is the element with atomic number 39, and the elements from lanthanum (La) with atomic number 57 to lutetium (Lu) with atomic number 71 that are lanthanoids. Further, in the present description the term "REM content" refers to the total content of these elements.

The chemical composition of the steel material described above may further contain one or more types of element selected from the group consisting of Co and W in lieu of a part of Fe. Each of these elements is an optional element that forms a protective corrosion coating in a sour environment and suppresses hydrogen penetration. By this means, each of these elements increases the SSC resistance of the steel material.

Co: 0 to 0.50%

Cobalt (Co) is an optional element, and need not be contained. In other words, the Co content may be 0%. If contained, Co forms a protective corrosion coating in a sour environment and suppresses hydrogen penetration. As a result, the SSC resistance of the steel material increases. If even a small amount of Co is contained, this effect is obtained to a certain extent. However, if the Co content is too high, the hardenability of the steel material will decrease, and the strength of the steel material will decrease. Therefore, the Co content is within the range of 0 to 0.50%. A preferable lower limit of the Co content is more than 0%, more preferably is 0.02%, further preferably is 0.03%, and further preferably is 0.05%. A preferable upper limit of the Co content is 0.45%, and more preferably is 0.40%.

W: 0 to 0.50%

Tungsten (W) is an optional element, and need not be contained. In other words, the W content may be 0%. If contained, W forms a protective corrosion coating in a sour environment and suppresses hydrogen penetration. As a result, the SSC resistance of the steel material increases. If even a small amount of W is contained, this effect is obtained to a certain extent. However, if the W content is too high, course carbides form in the steel material and the SSC resistance of the steel material decreases. Therefore, the W content is within the range of 0 to 0.50%. A preferable lower limit of the W content is more than 0%, more preferably is 0.02%, further preferably is 0.03%, and further preferably is 0.05%. A preferable upper limit of the W content is 0.45%, and more preferably is 0.40%.

[Regarding BN]

In the steel material according to the present embodiment, the number density of BN contained in the steel material is within the range of 10 to 100 particles/100 $\mu m^2$. Note that, in the present description, the term "BN" means a precipitate having an equivalent circular diameter within a range of 10 to 100 nm in which, among the elements of the chemical composition of the steel material according to the present embodiment, an element other than B, N, a sheet-mesh derived element and a carbon deposited film (replica film) derived element are not detected. Note that, in the present description, the term "equivalent circular diameter" means the diameter of a circle in a case where the area of an identified precipitate on a visual field surface during microstructure observation is converted into a circle having the same area.

As described above, in the steel material according to the present embodiment, the Cr, Mo, and V contents are adjusted to increase the temper softening resistance of the steel material. That is, the yield strength after tempering is increased by adjusting the chemical composition as described above. On the other hand, in the steel material having the above-mentioned chemical composition, coarse precipitates are confirmed at prior-austenite grains boundaries (prior-γ grain boundaries) in some cases. In such a case, the SSC resistance of the steel material decreases.

Therefore, in the steel material according to the present embodiment, BN is caused to disperse in the steel material. As mentioned above, B is liable to segregate at prior-γ grain boundaries. B also combines with N to form BN and precipitate in the steel material. Therefore, by actively causing BN to precipitate, the precipitation of coarse precipitates can be inhibited. In this case, the SSC resistance of the steel material can be increased. On the other hand, if too much BN precipitates, the SSC resistance of steel material will, on the contrary, decrease. The present inventors consider that the reason for this is that the steel material is embrittled due to the amount of precipitates being too large.

Therefore, in the steel material according to the present embodiment, the number density of BN contained in the steel material is in the range of 10 to 100 particles/100 $\mu m^2$. A preferable lower limit of the number density of BN in the steel material is 12 particles/100 $\mu m^2$. A preferable upper limit of the number density of BN in the steel material is 90 particles/100 $\mu m^2$, and more preferably is 80 particles/100 $\mu m^2$ The number density of BN in the steel material according to the present embodiment can be determined by the following method. A micro test specimen for creating an extraction replica is taken from the steel material according to the present embodiment. If the steel material is a steel plate, the micro test specimen is taken from a center portion of the thickness. If the steel material is a steel pipe, the micro test specimen is taken from a center portion of the wall thickness. After polishing the surface of the micro test specimen to obtain a mirror surface, the micro test specimen is immersed for 600 seconds in a 3.0% nital etching reagent at a temperature of 25±1° C. to etch the surface. The etched surface is then covered with a carbon deposited film. The micro test specimen whose surface is covered with the deposited film is immersed for 1200 seconds in a 5.0% nital etching reagent at a temperature of 25±1° C. The deposited film is peeled off from the immersed micro test specimen. The deposited film that was peeled off from the micro test specimen is cleaned with ethanol, and thereafter is scooped up with a sheet mesh made from Cu and dried.

The deposited film (replica film) is observed using a transmission electron microscope (TEM). Specifically, an arbitrary four locations are identified, and observation is conducted using an observation magnification of ×30000 and an acceleration voltage of 200 kV, and photographic images are generated. In addition, with respect to the same observation visual fields, elementary analysis is performed by Energy Dispersive X-ray Spectrometry (hereunder, also referred to as "EDS"), and an element map is generated. Note that, each visual field is 5 μm×5 μm. In addition, precipitates can be identified based on contrast, and image processing for the obtained photographic images can be performed to identify that the equivalent circular diameter is in the range of 10 to 100 nm.

Note that, in EDS, because of the characteristics of the apparatus, among the elements of the chemical composition of the steel material according to the present embodiment, although elements excluding B and N, such as Fe, Cr, Mn, Mo, V and Nb are detected, B and N are not detected in some cases. However, among precipitates having an equivalent circular diameter of 10 to 100 nm, precipitates that do not include an element other than B and N among the elements of the chemical composition of the steel material according to the present embodiment are almost all BN. Further, in the present embodiment, as mentioned above, when performing elementary analysis by EDS, a sheet mesh made from Cu is used. Therefore, in the elementary analysis by EDS according to the present embodiment. Cu is detected at a level that is more than an impurity level. Furthermore, in the present embodiment, as mentioned above, precipitates captured at a carbon deposited film (replica film) are performed elementary analysis by EDS. Therefore, in the elementary analysis by EDS according to the present embodiment, C is also detected at a level that is more than an impurity level in some cases.

Thus, in the present embodiment, BN is defined as a precipitate having an equivalent circular diameter within a range of 10 to 100 nm in which, among the elements of the chemical composition of the steel material according to the present embodiment, an element other than B, N, a sheet-mesh derived element and a carbon deposited film (replica film) derived element are not detected. Note that, B, N, a sheet-mesh derived element and a carbon deposited film (replica film) derived element may be detected by EDS, and may not be detected. For example, a precipitate having an equivalent circular diameter within a range of 10 to 100 nm and detected only a sheet-mesh derived element by EDS is determined as BN. For example, a precipitate having an equivalent circular diameter within a range of 10 to 100 nm, detected B, N, a sheet-mesh derived element and a carbon deposited film (replica film) derived element, and not detected the other elements is determined as BN. Therefore, in the present embodiment, a precipitate having an equivalent circular diameter within a range of 10 to 100 nm, in which any other elements than B, N, a sheet-mesh derived element and a carbon deposited film (replica film) derived element are not detected by EDS, is determined as BN. Furthermore, in the present embodiment, a precipitate having an equivalent circular diameter within a range of 10 to 100 nm, in which no element is detected by EDS, is also determined as BN.

As mentioned above, in the present embodiment the phrase "sheet-mesh derived element" refers to Cu. Further, in the present embodiment the phrase "a carbon deposited film (replica film) derived element" refers to C. Therefore, in the present embodiment, in practice the term "BN" means a precipitate having an equivalent circular diameter within a range of 10 to 100 nm in which, among the elements of the chemical composition of the steel material according to the present embodiment, an element other than B, N, Cu and C is not detected. Note that, in the present description, the description "among the elements of the chemical composition of the steel material according to the present embodiment, an element other than B, N, Cu and C is not detected" means that in an elementary analysis by EDS, among the elements of the chemical composition of the steel material according to the present embodiment, an element other than B, N, Cu and C is not detected at a level that is more than an impurity level.

Note that, in some cases, a sheet mesh that is used during TEM observation may be constituted by an element other than Cu. For example, in a case where a sheet mesh made of Ni is used, Ni will be unavoidably detected in an elementary analysis by EDS. In this case, BN means a precipitate having an equivalent circular diameter within a range of 10 to 100 nm in which, among the elements of the chemical composition of the steel material according to the present embodiment, an element other than B, N, Ni and C is not detected.

According to the present embodiment, specifically, precipitates having an equivalent circular diameter within a range of 10 to 100 nm that are identified from the above-mentioned photographic images, and the element map are compared, and among the precipitates having an equivalent circular diameter within a range of 10 to 100 nm, precipitates (BN) in which an element other than B, N, Cu and C among the elements of the chemical composition of the steel material according to the present embodiment is not detected are identified. The number density of BN (particles/100 $\mu m^2$) can be determined based on the total number of BN precipitates identified in the four visual fields and the gross area of the four visual fields.

[Yield Strength of Steel Material]

The yield strength of the steel material according to the present embodiment is 758 MPa or more (110 ksi or more). In the present description, the term "yield strength" means 0.2% offset proof stress obtained in a tensile test. Even though the steel material according to the present embodiment has a yield strength of 110 ksi or more, by satisfying the conditions regarding the chemical composition and the number density of BN which are described above, the steel material according to the present embodiment has excellent SSC resistance in a sour environment.

The yield strength of the steel material according to the present embodiment can be determined by the following method. A tensile test is conducted in a method in accordance with ASTM E8/E8M (2013). A round bar test specimen is taken from a steel material according to the present embodiment. If the steel material is a steel plate, a round bar test specimen is taken from a center portion of the thickness. If the steel material is a steel pipe, a round bar test specimen is taken from a center portion of the wall thickness. The size of the round bar test specimen is, for example, 4 mm in the diameter of the parallel portion and 35 mm in the length of the parallel portion. The axial direction of the round bar test specimen is parallel to the rolling direction of the steel material. A tensile test is performed at normal temperature (25° C.) in the atmosphere using the round bar test specimen, and obtained 0.2% offset proof stress is defined as the yield strength (MPa).

[Microstructure]

The microstructure of the steel material according to the present embodiment is principally composed of tempered martensite and tempered bainite. Specifically, the total of the volume ratios of tempered martensite and tempered bainite is 90% or more in the microstructure. The balance of the microstructure is, for example, ferrite or pearlite. If the microstructure of the steel material having the aforementioned chemical composition contains tempered martensite and tempered bainite in an amount equivalent to a total volume ratio of 90% or more, on the condition that the other requirements according to the present embodiment are satisfied, the yield strength of the steel material will be 758 MPa or more (110 ksi or more).

The total volume ratios of tempered martensite and tempered bainite can be determined by microstructure observation. In a case where the steel material is a steel plate, a test specimen having an observation surface with dimensions of 10 mm in the rolling direction and 10 mm in the thickness direction is cut out from a center portion of the thickness. In addition, in a case where the steel material is a steel plate having a thickness of less than 10 mm, a test specimen having an observation surface with dimensions of 10 mm in the rolling direction and the thickness of the steel plate in the thickness direction is cut out. In a case where the steel material is a steel pipe, a test specimen having an observation surface with dimensions of 10 mm in the pipe axis direction and 10 mm in the pipe radial direction is cut out from a center portion of the wall thickness. In addition, in a case where the steel material is a steel pipe having a wall thickness of less than 10 mm, a test specimen having an observation surface with dimensions of 10 mm in the pipe axis direction and a wall thickness of the steel pipe in the pipe radial direction is cut out. After polishing the observation surface to obtain a mirror surface, the test specimen is immersed for about 10 seconds in a 2% nital etching reagent, to reveal the microstructure by etching. The etched observation surface is observed by means of a secondary electron image obtained using a scanning electron microscope (SEM), and observation is performed for 10 visual fields. The area of each visual field is 400 $\mu m^2$ (magnification of ×5000).

In each visual field, tempered martensite and tempered bainite can be distinguished from other phases (ferrite or pearlite) based on contrast. Therefore, in each visual field, tempered martensite and tempered bainite are identified based on contrast. Then a total of area fractions of the identified tempered martensite and tempered bainite is determined. In the present embodiment, an arithmetic average value of the totals of area fractions of tempered martensite and tempered bainite determined in all visual fields is made to be a total volume ratio of tempered martensite and tempered bainite.

[Prior-Austenite Grain Diameter]

In the microstructure of the steel material according to the present embodiment, the prior-austenite grain diameter (prior-f grain diameter) is not particularly limited. In a case where the steel material is an oil-well steel pipe, a preferable prior-γ grain diameter in the microstructure is 30 μm or less. Normally, in a steel material, if the prior-γ grain diameter is fine, yield strength and SSC resistance stably increase. However, because the steel material according to the present embodiment satisfies the conditions regarding the chemical composition and the number density of BN that are described above, even when the prior-γ grain diameter is within the range of 15 to 30 μm, the steel material according to the present embodiment has a yield strength of 758 MPa or more (110 ksi or more) and has excellent SSC resistance.

The prior-γ grain diameter can be determined by the following method. In a case where the steel material is a steel plate, a test specimen having an observation surface with dimensions of 10 mm in the rolling direction and 10 mm in the thickness direction is cut out from a center portion of the thickness. In addition, in a case where the steel material is a steel plate having a thickness of less than 10 mm, a test specimen having an observation surface with dimensions of 10 mm in the rolling direction and the thickness of the steel plate in the thickness direction is cut out. In a case where the steel material is a steel pipe, a test specimen having an observation surface with dimensions of 10 mm in the pipe axis direction and 10 mm in the pipe radial direction is cut out from a center portion of the wall thickness. In addition, in a case where the steel material is a steel pipe having a wall thickness of less than 10 mm, a test specimen having an observation surface with dimensions of 10 mm in the pipe axis direction and a wall thickness of the steel pipe in the pipe radial direction is cut out. After the test specimen is embedded in a resin, the observation surface of the test specimen is polished to obtain a mirror surface, and immersed for about 60 seconds in an aqueous solution saturated with picric acid, to reveal prior-γ grain boundaries by etching.

The etched observation surface is observed by means of a secondary electron image obtained using an SEM, and observation is performed for 10 visual fields, and photographic images are generated. The areas of the respective prior-γ grains are determined based on the generated photographic images, and the equivalent circular diameter of each prior-γ grains is determined based on the area of the prior-γ grain. An arithmetic average value of the equivalent circular diameters of the prior-γ grains that are determined in the 10 visual field is defined as the prior-γ grain diameter (μm).

[Shape of Steel Material]

The shape of the steel material according to the present embodiment is not particularly limited. The steel material is, for example, a steel pipe or a steel plate. In a case where the steel material is an oil-well steel pipe, a preferable wall thickness is 9 to 60 mm. More preferably, the steel material according to the present embodiment is suitable for use as a heavy-wall seamless steel pipe. More specifically, even if the steel material according to the present embodiment is a seamless steel pipe having a thick wall with a thickness of 15 mm or more or, furthermore, 20 mm or more, the steel material exhibits excellent strength and excellent SSC resistance.

[SSC Resistance of Steel Material]

In the steel material according to the present embodiment, excellent SSC resistance is determined for each yield strength. Note that, for each yield strength, the SSC resistance of the steel material according to the present embodiment can be evaluated by a DCB test performed in accordance with "Method D" described in NACE TM0177-2005.

[SSC Resistance when Yield Strength is 758 to Less than 862 MPa]

Figure 2A:
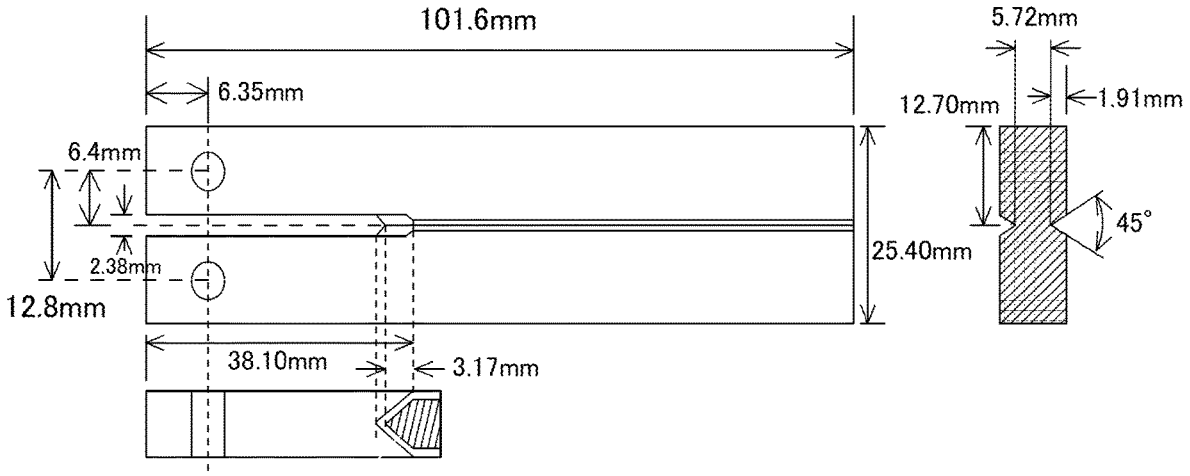
FIG. 2A shows a side view and a cross-sectional view of a DCB test specimen that is used in a DCB test in the present embodiment.
Figure 2B:
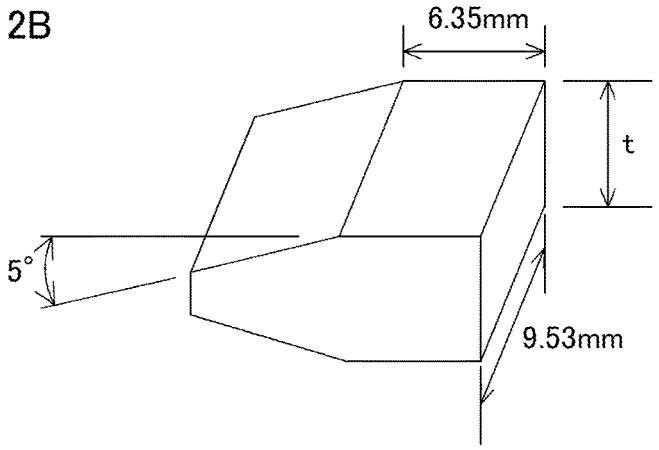
FIG. 2B is a perspective view of a wedge that is used in the DCB test in the present embodiment.

In a case where the yield strength of the steel material is within a range of 758 to less than 862 MPa (110 to less than 125 ksi, 110 ksi grade), the SSC resistance of the steel material can be evaluated by the following method. An aqueous solution containing 5.0 mass % of sodium chloride is adopted as a test solution. A DCB test specimen illustrated in FIG. 2A is taken from the steel material according to the present embodiment. In a case where the steel material is a steel plate, the DCB test specimen is taken from a center portion of the thickness. In a case where the steel material is a steel pipe, the DCB test specimen is taken from a center portion of the wall thickness. The longitudinal direction of the DCB test specimen is parallel with the rolling direction of the steel material. A wedge illustrated in FIG. 2B is also taken from the steel material according to the present embodiment. A thickness t of the wedge is 3.10 (mm).

Referring to FIG. 2A, the aforementioned wedge is driven in between the arms of the DCB test specimen. The DCB test specimen into which the wedge was driven is then enclosed inside a test vessel. Thereafter, the aforementioned test solution is poured into the test vessel so as to leave a vapor phase portion, and is adopted as a test bath. The amount adopted for the test bath is 1 L per test specimen. Next, $N_2$ gas is blown into the test bath for three hours to degas the test bath until the dissolved oxygen in the test bath becomes 20 ppb or less.

$H_2S$ gas at 5 atm (0.5 MPa) is blown into the degassed test bath to make the test bath a corrosive environment. The pH of the test bath is adjusted to within the range of 3.5 to 4.0 throughout the immersion period. The inside of the test vessel is maintained at 24±3° C. for 14 days (336 hours) while stirring the test bath. After being held, the DCB test specimen is taken out from the test vessel.

A pin is inserted into a hole formed in the tip of the arms of each DCB test specimen that is taken out and a notch portion is opened with a tensile testing machine, and a wedge releasing stress P is measured. In addition, the notch in the DCB test specimen is released in liquid nitrogen, and a crack propagation length "a" with respect to crack propagation that occurred during immersion is measured. The crack propagation length "a" is measured visually using vernier calipers. A fracture toughness value $K_{ISSC}$ (MPa√m) is determined using Formula (I) based on the obtained wedge releasing stress P and the crack propagation length "a".

$$K_{1SSC} = \frac{Pa\left(2\sqrt{3} + 2.38^{h/a}\right)\left(B/Bn\right)^{1/\sqrt{3}}}{Bh^{3/2}} \quad (1)$$

In Formula (1), h represents the height (mm) of each arm of the DCB test specimen. B represents the thickness (mm) of the DCB test specimen, and Bn represents the web thickness (mm) of the DCB test specimen. These are defined in "Method D" of NACE TM0177-2005. For the steel material according to the present embodiment, in a case where the yield strength is within a range of 758 to less than 862 MPa, the fracture toughness value $K_{ISSC}$ that is determined in the aforementioned DCB test is 29.0 MPa√m or more.

[SSC Resistance when Yield Strength is 862 MPa or More]

In a case where the yield strength of the steel material is 862 MPa or more (125 ksi or more), the SSC resistance of the steel material can be evaluated by the following method. A mixed aqueous solution containing 5.0 mass % of sodium chloride, 2.5 mass % of acetic acid and 0.41 mass % of sodium acetate (NACE solution B) is adopted as a test solution. In a similar manner to the case where the yield strength is within a range of 758 to less than 862 MPa, a DCB test specimen illustrated in FIG. 2A and a wedge illustrated in FIG. 2B are taken from the steel material according to the present embodiment. Note that, a thickness t of the wedge is 3.10 (mm).

In a similar manner to the case where the yield strength is within a range of 758 to less than 862 MPa, the DCB test specimen into which the wedge was driven in between the arm is then enclosed inside a test vessel. Thereafter, the aforementioned test solution is poured into the test vessel so as to leave a vapor phase portion, and is adopted as a test bath. The amount adopted for the test bath is 1 L per test specimen. Next, $N_2$ gas is blown into the test bath for three hours to degas the test bath until the dissolved oxygen in the test bath becomes 20 ppb or less.

A mixed gas containing $H_2S$ at 0.3 atm (0.03 MPa) and $CO_2$ at 0.7 atm (0.07 MPa) is blown into the degassed test bath to make the test bath a corrosive environment. The pH of the test bath is adjusted to within the range of 3.5 to 4.0 throughout the immersion period. The inside of the test vessel is maintained at 24±3° C. for 17 days (408 hours) while stirring the test bath. After being held, the DCB test specimen is taken out from the test vessel.

In a similar manner to the case where the yield strength is within a range of 758 to less than 862 MPa, a fracture toughness value $K_{ISSC}$ (MPa√m) is determined using Formula (1) based on the obtained wedge releasing stress P and the crack propagation length "a". For the steel material according to the present embodiment, in a case where the yield strength is 862 MPa or more, the fracture toughness value $K_{ISSC}$ that is determined in the aforementioned DCB test is 27.0 MPa√m or more.

[Production Method]

The method for producing a steel material according to the present embodiment is described hereunder. The method for producing a steel material according to the present embodiment includes a preparation process, a quenching process, and a tempering process. The preparation process may include a starting material preparation process and a hot working process. In the present embodiment, a method for producing a seamless steel pipe will be described as one example of a method for producing a steel material. The method for producing a seamless steel pipe includes a process of preparing a hollow shell (preparation process), and a process of subjecting the hollow shell to quenching and tempering to make a seamless steel pipe (quenching process and tempering process). Note that, the method for producing the steel material according to the present embodiment is not limited to the production method described hereunder. Each of these processes is described in detail hereunder.

[Preparation Process]

In the preparation process, an intermediate steel material having the aforementioned chemical composition is prepared. The method for producing the intermediate steel material is not particularly limited as long as the intermediate steel material has the aforementioned chemical composition. As used here, the term "intermediate steel material" refers to a plate-shaped steel material in a case where the end product is a steel plate, and refers to a hollow shell in a case where the end product is a steel pipe.

The preparation process may include a process in which a starting material is prepared (starting material preparation process), and a process in which the starting material is subjected to hot working to produce an intermediate steel material (hot working process). Hereunder, a case in which the preparation process includes the starting material preparation process and the hot working process is described in detail.

[Starting Material Preparation Process]

In the starting material preparation process, a starting material is produced using molten steel having the aforementioned chemical composition. The method for producing the starting material is not particularly limited, and a well-known method can be used. Specifically, a cast piece (a slab, bloom or billet) is produced by a continuous casting process using the molten steel. An ingot may also be produced by an ingot-making process using the molten steel. As necessary, the slab, bloom or ingot may be subjected to blooming to produce a billet. The starting material (a slab, bloom or billet) is produced by the above described process.

[Hot Working Process]

In the hot working process, the starting material that was prepared is subjected to hot working to produce an intermediate steel material. In a case where the steel material is a steel pipe, the intermediate steel material corresponds to a hollow shell. First, the billet is heated in a heating furnace. Although the heating temperature is not particularly limited, for example, the heating temperature is within a range of 1100 to 1300° C. The billet that is extracted from the heating furnace is subjected to hot working to produce a hollow shell (seamless steel pipe). The method of performing the hot working is not particularly limited, and a well-known method can be used. For example, the Mannesmann process is performed as the hot working to produce the hollow shell. In this case, a round billet is piercing-rolled using a piercing machine. When performing piercing-rolling, although the piercing ratio is not particularly limited, the piercing ratio is, for example, within a range of 1.0 to 4.0. The round billet that underwent piercing-rolling is further hot-rolled to form a hollow shell using a mandrel mill, a reducer, a sizing mill or the like. The cumulative reduction of area in the hot working process is, for example, 20 to 70%.

A hollow shell may also be produced from the billet by another hot working method. For example, in the case of a heavy-wall steel material of a short length such as a coupling, a hollow shell may be produced by forging such as Ehrhardt process. A hollow shell is produced by the above process. Although not particularly limited, the wall thickness of the hollow shell is, for example, 9 to 60 mm.

The hollow shell produced by hot working may be air-cooled (as-rolled). The hollow shell produced by hot working may be subjected to direct quenching after hot working without being cooled to normal temperature, or may be subjected to quenching after undergoing supplementary heating (reheating) after hot working. However, in the case of performing direct quenching or quenching after supplementary heating, it is preferable to stop the cooling midway through the quenching process and conduct slow cooling for the purpose of suppressing quench cracking.

In a case where direct quenching is performed after hot working, or quenching is performed after supplementary heating after hot working, for the purpose of eliminating residual stress it is preferable to perform a stress relief treatment (SR treatment) at a time that is after quenching and before a heat treatment (tempering or the like) of the next process.

As described above, an intermediate steel material is prepared in the preparation process. The intermediate steel material may be produced by the aforementioned preferable process, or may be an intermediate steel material that was produced by a third party, or an intermediate steel material that was produced in another factory other than the factory in which a quenching process and a tempering process that are described later are performed, or at a different work. The quenching process is described in detail hereunder.

[Quenching Process]

In the quenching process, the intermediate steel material (hollow shell) that was prepared is subjected to quenching. In the present description, the term "quenching" means, after the intermediate steel material is heated once to a temperature not less than the $A_{c3}$ point, rapidly cooling the intermediate steel material that is at a temperature not less than the $A_{r3}$ point. In addition, in the quenching, the intermediate containing the microstructure principally composed of austenite is rapidly cooled. As a result, after quenching, the intermediate steel material contained the microstructure that is principally composed martensite and/or bainite can be obtained. That is, in a case where the microstructure of the intermediate steel material is not principally composed of austenite, even if the intermediate steel material is rapidly cooled, the effect of the quenching is not obtained. Therefore, in the quenching, it is usually heated the intermediate steel material to $A_{c3}$ point or more before rapidly cooling.

Figure 3:
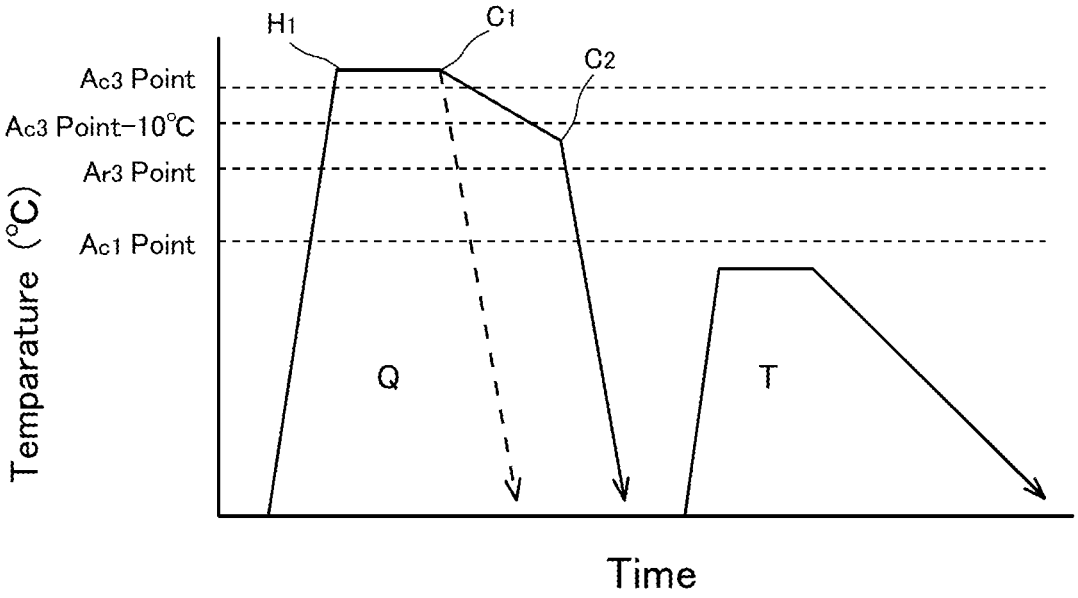
FIG. 3 is a schematic diagram illustrating a heat pattern during quenching and tempering in the present embodiment.

FIG. 3 is a schematic diagram illustrating a heat pattern in a quenching process and a tempering process in the production method of the present embodiment. In FIG. 3, after subjecting the intermediate steel material to quenching ("Q" in FIG. 3), the intermediate steel material is subjected to tempering ("T" in FIG. 3). Hereunder, the quenching process according to the present embodiment is described with reference to FIG. 3.

Specifically, a heat pattern of a conventional quenching process is indicated by a broken line in FIG. 3. On the other hand, the heat pattern of the quenching process according to the present embodiment is indicated by a solid line in FIG. 3. Referring to FIG. 3, in the conventional quenching process, the intermediate steel material is heated to not less than the $A_{c3}$ point ($H_1$ in FIG. 3). As described above, the microstructure of the intermediate steel material becomes austenite by heating the intermediate steel material to $A_{c3}$ point or more. Next, after the intermediate steel material has been kept at a temperature not less than the $A_{c3}$ point, the intermediate steel material is subjected to rapid cooling from a temperature not less than the $A_{c3}$ point ($C_1$ in FIG. 3).

On the other hand, in the quenching process according to the present embodiment, the intermediate steel material is heated to not less than the $A_{c3}$ point ($H_1$ in FIG. 3), similarly to the conventional quenching process. Next, the intermediate steel material is subjected to a first cooling from a temperature not less than the $A_{c3}$ point ($C_1$ in FIG. 3) to a temperature within the range of the $A_{r3}$ point to the $A_{c3}$ point −10° C. ($C_2$ in FIG. 3). After the first cooling, the intermediate steel material is subjected to a second cooling from the temperature within the range of the $A_{r3}$ point to the $A_{c3}$ point −10° C. (CG in FIG. 3).

As illustrated in FIG. 3, the quenching process according to the present embodiment includes a process of heating the intermediate steel material and holding the intermediate steel material at the heated temperature (heating and holding process), a process of cooling the intermediate steel material from the temperature at which the intermediate steel material was heated and held to a temperature within the range of the $A_{r3}$ point to the $A_{c3}$ point −10° C. (first cooling process), and a process of rapidly cooling the intermediate steel material from the temperature within the range of the $A_{r3}$ point to the $A_{c3}$ point −10° C. (second cooling process). Each of these processes is described in detail hereunder.

[Heating and Holding Process]

In the heating and holding process, the intermediate steel material is heated to not less than the $A_{c3}$ point. Specifically, in the heating and holding process according to the present embodiment, the heating temperature before quenching (i.e., the quenching temperature) is within the range of 880 to 1000° C. In the present description, the quenching temperature corresponds to the temperature of a supplementary heating furnace or a heat treatment furnace that is used for reheating the intermediate steel material after hot working.

If the quenching temperature is too high, the prior-γ grain diameters may become too large. In such a case, the SSC resistance of the steel material will decrease. On the other hand, if the quenching temperature is too low, in some cases the microstructure does not become one that is principally composed of martensite and bainite after quenching. In such a case, the mechanical properties described in the present embodiment are not obtained in the steel material Therefore, in the quenching process according to the present embodiment, the quenching temperature is within the range of 880 to 1000° C.

[First Cooling Process]

In the first cooling process, the intermediate steel material after the heating process is cooled for 60 to 300 seconds from the temperature of the heated intermediate steel material (i.e., the quenching temperature) to a rapid cooling starting temperature of the second cooling process that is described later.

As mentioned above, in a steel material having the chemical composition according to the present embodiment, in some cases coarse precipitates may form at prior-γ grain boundaries. In such a case, the SSC resistance of steel material decreases. On the other hand, BN is formed in the steel material in a temperature range from the $A_{r3}$ point to less than the $A_{c3}$ point of the steel material according to the present embodiment. BN is also liable to be formed at prior-γ grain boundaries. That is, if the intermediate steel material is held to a certain extent within a temperature range from the $Ar_3$ point to less than the $A_{c3}$ point, BN precipitates in the intermediate steel material, and the SSC resistance of the steel material increases.

Therefore, in the first cooling process according to the present embodiment, the intermediate steel material is cooled for a period of 60 to 30) seconds from the quenching temperature to a rapid cooling starting temperature. As mentioned above, the quenching temperature according to the present embodiment is not less than the $A_{c3}$ point. Further, the rapid cooling starting temperature according to the present embodiment is within a range of the Ar point of the steel material to the $A_{c3}$ point of the steel material −10° C. Therefore, by cooling the intermediate steel material from the quenching temperature to the rapid cooling starting temperature for a period of 60 to 300 seconds, the intermediate steel material is held for a certain extent in a temperature range from the $A_{r3}$ point to less than the $A_{c3}$ point. As a result, BN can be caused to precipitate in the intermediate steel material.

As described above, in the quenching process according to the present embodiment, BN is actively caused to precipitate in the intermediate steel material. By causing BN to precipitate during the first cooling process, precipitation of coarse precipitates during a tempering process that is described later can be inhibited. As a result, coarse precipitates are reduced in the steel material according to the present embodiment, and the steel material exhibits excellent SSC resistance.

If the time period in which the temperature of the intermediate steel material is cooled from the quenching temperature to the rapid cooling starting temperature (first cooling time period) is too short, BN will not be sufficiently formed in the steel material. Therefore, the number density of BN in the steel material will be too low and the SSC resistance of the steel material will not be obtained. On the other hand, if the first cooling time period is too long, too much BN will be formed in the steel material. In such case, the number density of BN in the steel material will be too high, and the SSC resistance of the steel material will not be obtained.

Therefore, in the first cooling process according to the present embodiment, the first cooling time period is within the range of 60 to 300 seconds. A preferable lower limit of the first cooling time period is 65 seconds, and more preferably is 70 seconds. A preferable upper limit of the first cooling time period is 250 seconds, and more preferably is 200 seconds.

Note that, the cooling method in the first cooling process is not particularly limited as long as cooling can be performed from the aforementioned quenching temperature to the rapid cooling starting temperature for a period within the range of 60 to 300 seconds. The cooling method in the first cooling process according to the present embodiment is, for example, air-cooling, allowing cooling, or slow cooling.

[Second Cooling Process]

In the second cooling process, the intermediate steel material that was cooled by the first cooling process is rapidly cooled. In the second cooling process according to the present embodiment, the temperature at which rapid cooling is started (that is, a rapid cooling starting temperature) is within the range of the $A_{r3}$ point to the $A_{c3}$ point −10° C. In the present description, the term "rapid cooling starting temperature" means the surface temperature of the intermediate steel material on the entrance side of the cooling equipment for rapidly cooling the intermediate steel material.

If the rapid cooling starting temperature is too low, in some cases the microstructure does not become one that is principally composed of martensite and bainite after quenching. In such a case, the mechanical properties described in the present embodiment are not obtained in the steel material. On the other hand, if the rapid cooling starting temperature is too high, the time period for which the temperature of the intermediate steel material is held in a temperature range ($A_{r3}$ point to $A_{c3}$ point) in which BN precipitates will shorten. In such a case, BN will not be sufficiently formed in the steel material, and the SSC resistance of the steel material will not be obtained.

Therefore, in the second cooling process according to the present embodiment, the rapid cooling starting temperature is within the range of the $A_{r3}$ point to the $A_{c3}$ point −10° C. A preferable lower limit of the rapid cooling starting temperature is the $A_{c3}$ point +5° C., and more preferably is the $A_{r3}$ point +10° C. A preferable upper limit of the rapid cooling starting temperature is the $A_{c3}$ point −15° C., and more preferably is the $A_{c3}$ point −20° C.

In the second cooling process, the method used to rapidly cool the intermediate steel material is, for example, continuously cooling the intermediate steel material (hollow shell) from the quenching starting temperature, to thereby continuously decrease the surface temperature of the hollow shell. The method of performing the continuous cooling treatment is not particularly limited and a well-known method can be used. The method of performing the continuous cooling treatment is, for example, a method that cools the intermediate steel material by immersing the intermediate steel material in a water bath, or a method that cools the intermediate steel material in an accelerated manner by shower water cooling or mist cooling.

If the cooling rate in the second cooling process is too slow, in some cases the microstructure does not become one that is principally composed of martensite and bainite after quenching. In such a case, the mechanical properties described in the present embodiment are not obtained in the steel material. Therefore, as described above, in the method for producing a steel material according to the present embodiment, the intermediate steel material is subjected to rapid cooling in the second cooling process. Specifically, in the second cooling process, the average cooling rate when the surface temperature of the intermediate steel material (hollow shell) is within the range of the $A_{r3}$ point to 500° C. during quenching is defined as the cooling rate during quenching.

In the quenching process of the present embodiment, the cooling rate during quenching is 50° C./min or more. A preferable lower limit of the cooling rate during quenching is 100° C./min. Although an upper limit of the cooling rate during quenching is not particularly defined, for example, the upper limit is 60000° C./min.

As described above, because the steel material according to the present embodiment satisfies the conditions regarding the chemical composition and the number density of BN that are described above, even when the prior-γ grain diameter is within the range of 15 to 30 μm, the steel material according to the present embodiment has a yield strength of 758 MPa or more (110 ksi or more) and has excellent SSC resistance in a sour environment. Note that, the quenching process according to the present embodiment may be performed only one time. On the other hand, quenching may be performed after performing heating of the intermediate steel material in the austenite zone a plurality of times. In this case, the SSC resistance of the steel material further increases because austenite grains are refined prior to quenching. Heating in the austenite zone may be repeated a plurality of times by performing quenching a plurality of times, or heating in the austenite zone may be repeated a plurality of times by performing normalizing and quenching. Hereunder, the tempering process will be described in detail.

[Tempering Process]

In the tempering process, tempering is performed on the intermediate steel material which has been subjected to the aforementioned quenching process. As used in the present description, the term "tempering" means reheating and holding the intermediate steel material after quenching at a temperature that is not more than the $A_{c1}$ point. Specifically, as illustrated in FIG. 3, the tempering temperature in the tempering process according to the present embodiment is not more than the $A_{c1}$ point. The tempering temperature is appropriately adjusted in accordance with the chemical composition of the steel material and the yield strength to be obtained. That is, the tempering temperature is adjusted for the intermediate steel material which has the chemical composition of the present embodiment, so that the yield strength of the steel material is adjusted to within the range of 758 MPa or more (110 ksi or more). Here, the term "tempering temperature" corresponds to the temperature of the furnace when the intermediate steel material after quenching is heated and held at the relevant temperature.

As described above, in the tempering process according to the present embodiment the tempering temperature is not more than the $A_{c1}$ point. Specifically, in the tempering process according to the present embodiment the tempering temperature is set within the range of 620 to 720° C. If the tempering temperature is 620° C. or more, carbides are sufficiently spheroidized and the SSC resistance is further increased. A preferable lower limit of the tempering temperature is 630° C., and further preferably is 650° C. A more preferable upper limit of the tempering temperature is 715° C., and further preferably is 710° C.

In the present description, the term "holding time for tempering (tempering time)" means the time period from a time that the intermediate steel material is inserted into the furnace when heating and holding the intermediate steel material after quenching until a time that the intermediate steel material is taken out from the furnace. If the tempering time is too short, a microstructure that is principally composed of tempered martensite and/or tempered bainite may not be obtained in some cases. On the other hand, if the tempering time is too long, the aforementioned effect is saturated. Further, if the tempering time is too long, the desired yield strength may not be obtained in some cases. Therefore, in the tempering process of the present embodiment, the tempering time is preferably set within the range of 10 to 180 minutes. A more preferable lower limit of the tempering time is 15 minutes. A more preferable upper limit of the tempering time is 120 minutes, and further preferably is 100 minutes.

Note that, in a case where the steel material is a steel pipe, in comparison to other shapes, variations in the temperature of the steel pipe are liable to occur during holding for tempering. Therefore, in a case where the steel material is a steel pipe, the tempering time is preferably set within the range of 15 to 180 minutes. A person skilled in the art will be sufficiently capable of making the yield strength of the steel material having the chemical composition of the present embodiment fall within the range of 758 MPa or more by appropriately adjusting the aforementioned tempering temperature and the aforementioned holding time.

The steel material according to the present embodiment can be produced by the production method described above. Note that a method for producing a seamless steel pipe has been described as one example of the aforementioned production method. However, the steel material according to the present embodiment may be a steel plate or another shape. The method for producing a steel plate and other shapes also includes, like the above described production method, for example, a preparation process, a quenching process, and a tempering process. Furthermore, the aforementioned production method is one example, and the steel material according to the present embodiment may be produced by another production method.

Hereunder, the present invention is described more specifically by way of examples.

Example 1

In Example 1, in a case where the yield strength of the steel material is within a range of 758 to less than 862 MPa (110 ksi grade), the SSC resistance was investigated. Specifically, molten steels containing the chemical compositions shown in Table 1 were produced.

TABLE 1

| Test | Chemical Composition (in the unit of mass %, the balance being Fe and impurities) | | | | | | | | | | |
|---|---|---|---|---|---|---|---|---|---|---|---|
| Number | C | Si | Mn | P | S | Al | Cr | Mo | Ti | V | Nb |
| A | 0.27 | 0.28 | 0.38 | 0.010 | 0.0009 | 0.030 | 1.00 | 1.55 | 0.013 | 0.07 | 0.010 |
| B | 0.30 | 0.30 | 0.07 | 0.020 | 0.0013 | 0.035 | 0.90 | 1.12 | 0.008 | 0.08 | 0.010 |
| C | 0.31 | 0.35 | 0.50 | 0.010 | 0.0009 | 0.030 | 1.20 | 1.42 | 0.004 | 0.07 | 0.010 |
| D | 0.27 | 0.31 | 0.18 | 0.004 | 0.0011 | 0.030 | 0.77 | 0.91 | 0.007 | 0.08 | 0.012 |
| E | 0.30 | 0.30 | 0.47 | 0.020 | 0.0013 | 0.035 | 0.90 | 1.12 | 0.008 | 0.08 | 0.010 |
| F | 0.27 | 0.15 | 0.21 | 0.008 | 0.0007 | 0.028 | 0.75 | 0.93 | 0.011 | 0.10 | 0.010 |
| G | 0.25 | 0.34 | 0.45 | 0.008 | 0.0009 | 0.035 | 0.85 | 1.17 | 0.012 | 0.11 | 0.010 |
| H | 0.27 | 0.25 | 0.22 | 0.008 | 0.0007 | 0.029 | 0.83 | 1.11 | 0.006 | 0.10 | 0.015 |
| I | 0.31 | 0.33 | 0.20 | 0.007 | 0.0006 | 0.033 | 0.76 | 0.95 | 0.004 | 0.08 | 0.015 |
| J | 0.30 | 0.30 | 0.47 | 0.011 | 0.0010 | 0.030 | 1.00 | 1.43 | 0.012 | 0.05 | 0.010 |
| K | 0.30 | 0.30 | 0.35 | 0.011 | 0.0010 | 0.030 | 1.20 | 1.33 | 0.005 | 0.05 | 0.020 |
| L | 0.30 | 0.30 | 0.40 | 0.010 | 0.0012 | 0.035 | 2.00 | 0.95 | 0.009 | 0.05 | 0.010 |
| M | 0.28 | 0.32 | 0.43 | 0.007 | 0.0011 | 0.035 | 1.40 | 2.50 | 0.008 | 0.11 | 0.010 |

| Test | Chemical Composition (in the unit of mass %, the balance being Fe and impurities) | | | | | | | | | | |
|---|---|---|---|---|---|---|---|---|---|---|---|
| Number | B | Cu | Ni | N | O | Ca | Mg | Zr | REM | Co | W |
| A | 0.0022 | 0.01 | 0.01 | 0.0050 | 0.0011 | — | — | — | — | — | — |
| B | 0.0020 | 0.02 | 0.01 | 0.0040 | 0.0012 | 0.0012 | — | — | — | — | — |
| C | 0.0030 | 0.03 | 0.03 | 0.0040 | 0.0011 | 0.0008 | 0.0011 | — | — | — | — |
| D | 0.0022 | 0.02 | 0.03 | 0.0045 | 0.0011 | 0.0011 | — | 0.0011 | — | — | — |
| E | 0.0020 | 0.02 | 0.01 | 0.0040 | 0.0012 | 0.0012 | — | — | 0.0007 | — | — |
| F | 0.0018 | 0.04 | 0.04 | 0.0050 | 0.0010 | 0.0011 | 0.0005 | — | 0.0005 | — | — |
| G | 0.0015 | 0.02 | 0.02 | 0.0050 | 0.0010 | — | — | — | — | — | — |
| H | 0.0033 | 0.01 | 0.01 | 0.0050 | 0.0011 | — | — | — | — | 0.35 | — |
| I | 0.0030 | 0.01 | 0.01 | 0.0045 | 0.0011 | — | — | — | — | — | 0.33 |
| J | 0.0020 | 0.03 | 0.03 | 0.0050 | 0.0010 | — | — | — | — | — | — |
| K | 0.0040 | 0.03 | 0.03 | 0.0055 | 0.0010 | — | — | — | — | — | — |
| L | 0.0020 | 0.01 | 0.03 | 0.0050 | 0.0010 | — | — | — | — | — | — |
| M | 0.0020 | 0.02 | 0.03 | 0.0050 | 0.0011 | — | — | — | — | — | — |

The molten steels of Steels A to M were refined using the RH (Ruhrstahl-Hausen) method, and thereafter billets of Test Numbers 1-1 to 1-13 were produced by a continuous casting process. The thus-produced billets were held at 1250° C. for one hour, and thereafter was subjected to hot rolling (hot working) by the Mannesmann-mandrel process to produce a hollow shell (seamless steel pipe). The hollow shells of Test Numbers 1-1 to 1-13 after hot rolling were air-cooled such that the hollow shells have a normal temperature (25° C.).

After being allowed to cool, the hollow shells of Test Numbers 1-1 to 1-13 were heated and held for 20 minutes at the quenching temperature (° C.) shown in Table 2. Here, the temperature of the furnace in which reheating was performed was taken as the quenching temperature (° C.). After the hollow shells of Test Numbers 1-1 to 1-13 were allowed to cool after reheating, water-cooling was performed by means of water-cooling equipment. The time period from when the hollow shells of Test Numbers 1-1 to 1-13 that underwent reheating were taken out from the furnace until the time of entering the water-cooling equipment is shown in Table 2 as "first cooling time period (seconds)". The surface temperatures of the hollow shells of Test Numbers 1-1 to 1-13 that were measured by a radiation thermometer installed on the entrance side of the water-cooling equipment are shown in Table 2 as "rapid cooling starting temperature (° C.)". Note that, the $A_{c3}$ points of the hollow shells of Test Numbers 1-1 to 1-13 were all within the range of 850 to 870° C., and the $A_{r3}$ points of the hollow shells of Test Numbers 1-1 to 1-13 were all within the range of 650 to 700° C.

[BN Number Density Measurement Test]

For the steel pipes of Test Numbers 1-1 to 1-13, the number densities of BN were measured and calculated by the measurement method described above. The TEM used for measurement was manufactured by JEOL Ltd. (model name JEM-2010), and the acceleration voltage was set to 200 kV. The number densities of BN (particles/100 $\mu m^2$) for the steel pipes of Test Numbers 1-1 to 1-13 are shown in Table 2.

TABLE 2

| | | Quenching process | | | | | | | | $K_{1SSC}$ (MPa√m) | | | |
|---|---|---|---|---|---|---|---|---|---|---|---|---|---|
| Test Number | Steel | Quenching temperature (° C.) | First cooling time period (seconds) | Rapid cooling starting temperature (° C.) | Tempering temperature (° C.) | Prior-γ grain diameter (μm) | BN number density (particles/100 $\mu m^2$) | YS (MPa) | TS (MPa) | 1 | 2 | 3 | Average value |
| 1-1 | A | 900 | 85 | 800 | 705 | 25 | 12 | 793 | 891 | 31.5 | 32.0 | 31.7 | 31.7 |
| 1-2 | B | 910 | 100 | 750 | 700 | 20 | 16 | 808 | 908 | 31.0 | 30.5 | 31.5 | 31.0 |
| 1-3 | C | 900 | 110 | 730 | 700 | 15 | 60 | 813 | 925 | 31.3 | 30.6 | 31.2 | 31.0 |
| 1-4 | D | 905 | 90 | 770 | 700 | 20 | 30 | 810 | 913 | 31.0 | 31.5 | 31.2 | 31.2 |
| 1-5 | E | 890 | 60 | 815 | 700 | 17 | 20 | 800 | 899 | 30.8 | 31.5 | 30.4 | 30.9 |
| 1-6 | F | 900 | 90 | 780 | 700 | 20 | 32 | 814 | 916 | 32.3 | 31.6 | 31.2 | 31.7 |
| 1-7 | G | 920 | 120 | 710 | 700 | 20 | 10 | 813 | 923 | 31.5 | 32.1 | 31.5 | 31.7 |
| 1-8 | H | 920 | 60 | 815 | 700 | 20 | 25 | 820 | 895 | 29.5 | 30.0 | 29.5 | 29.7 |
| 1-9 | I | 920 | 80 | 800 | 710 | 18 | 30 | 815 | 925 | 28.5 | 29.5 | 29.5 | 29.2 |
| 1-10 | J | 920 | 20 | 900 | 700 | 20 | 4 | 818 | 915 | 27.0 | 26.3 | 26.0 | 26.4 |
| 1-11 | K | 920 | 360 | 710 | 700 | 15 | 110 | 800 | 899 | 27.3 | 27.8 | 26.5 | 27.2 |
| 1-12 | L | 920 | 90 | 800 | 710 | 15 | 24 | 820 | 921 | 24.3 | 24.7 | 25.5 | 24.8 |
| 1-13 | M | 920 | 90 | 800 | 705 | 20 | 30 | 815 | 916 | 26.3 | 22.8 | 25.5 | 24.9 |

The surface temperatures of the hollow shells of Test Numbers 1-1 to 1-13 that were measured by a radiation thermometer installed on the delivery side of the water-cooling equipment were all less than 100° C. The cooling rate in the second cooling process for the hollow shells of Test Numbers 1-1 to 1-13 were determined based on the rapid cooling starting temperature, the surface temperatures of the hollow shells of Test Numbers 1-1 to 1-13 on the delivery side of the water-cooling equipment, and the time required to move from the entrance side to the delivery side of the water-cooling equipment. The cooling rate in the second cooling process for the hollow shells of Test Numbers 1-1 to 1-13 were all 10° C. sec or more. Therefore, the cooling rate during quenching for Test Numbers 1-1 to 1-13 were each regarded as being 10° C./sec or more (i.e., 600° C./minutes or more). Next, tempering in which the hollow shells of Test Numbers 1-1 to 1-13 was held for 100 minutes at the tempering temperatures shown in Table 2 were performed, to thereby produce a steel pipes (seamless steel pipe) of Test Numbers 1-1 to 1-13. Note that, the tempering temperatures shown in Table 2 were all less than the $A_{c1}$ points of the corresponding steel.

[Evaluation Tests]

The steel pipes of Test Numbers 1-1 to 1-13 after the aforementioned tempering were subjected to microstructure observation, a BN number density measurement test, a tensile test and an SSC resistance evaluation test that are described hereunder.

[Microstructure Observation]

The prior-γ grain diameters of the steel pipes of Test Numbers 1-1 to 1-13 were measured by the method described above. The prior-γ grain diameters (μm) of the steel pipes of Test Numbers 1-1 to 1-13 are shown in Table 2.

[Tensile Test]

The yield strengths of the steel pipes of Test Numbers 1-1 to 1-13 were measured by the method described above. Specifically, a tensile test was performed in conformity with ASTM E8/E8M (2013). Round bar test specimens having a parallel portion diameter of 4 mm and a parallel portion length of 35 mm were prepared from the center portion of the wall thickness of the steel pipes of Test Numbers 1-1 to 1-13. The axial direction of the round bar test specimens was parallel to the rolling direction (pipe axis direction) of the steel pipe. A tensile test was performed in the atmosphere at normal temperature (25° C.) using the round bar test specimens of Test Numbers 1-1 to 1-13, and the yield strength (MPa) and the tensile strength (MPa) of the steel pipe of each test number were obtained. Note that, in the present examples, obtained 0.2% offset proof stress in the tensile test was defined as the yield strength for each test number. The largest stress during uniform elongation obtained in the tensile test was defined as the tensile strength for each test number. The obtained yield strengths are shown as "YS (MPa)" and tensile strengths are shown as "TS (MPa)" in Table 2.

[Test to Evaluate SSC Resistance of Steel Material]

The SSC resistance was evaluated by performing a DCB test in conformity with NACE TM0177-2005 Method D, using the steel pipes of Test Numbers 1-1 to 1-13. Specifically, three of the DCB test specimen illustrated in FIG. 2A were taken from a center portion of the wall thickness of the steel pipes of Test Numbers 1-1 to 1-13. The DCB test specimens were taken in a manner such that the longitudinal direction of each DCB test specimen was parallel with the rolling direction (pipe axis direction) of the steel pipe. A wedge illustrated in FIG. 2B was further taken from the steel pipes of Test Numbers 1-1 to 1-13. A thickness t of the wedge was 3.10 mm. The aforementioned wedge was driven into between the arms of the DCB test specimen.

An aqueous solution containing 5.0 mass % of sodium chloride was used as the test solution. The test solution was poured into the test vessel enclosing the DCB test specimen into which the wedge had been driven inside so as to leave a vapor phase portion, and was adopted as the test bath. The amount adopted for the test bath was 1 L per test specimen.

Next, $N_2$ gas was blown into the test bath for three hours to degas the test bath until the dissolved oxygen in the test bath became 20 ppb or less. $H_2S$ gas at 5 atm (0.5 MPa) was blown into the degassed test bath to make the test bath a corrosive environment. The pH of the test bath was adjusted to within the range of 3.5 to 4.0 throughout the immersion period. The inside of the test vessel was maintained at 24±3° C. for 14 days (336 hours) while stirring the test bath. After being held, the DCB test specimen was taken out from the test vessel.

A pin was inserted into a hole formed in the tip of the arms of the DCB test specimen that was taken out and a notch portion was opened with a tensile testing machine, and a wedge releasing stress P was measured. In addition, the notch in the DCB test specimen being immersed in the test bath was released in liquid nitrogen, and a crack propagation length "a" with respect to crack propagation that occurred during immersion was measured. The crack propagation length "a" could be measured visually using vernier calipers. A fracture toughness value $K_{ISSC}$ (MPa√m) was determined using Formula (1) based on the measured wedge releasing stress P and the crack propagation length "a". An arithmetic average value of obtained three fracture toughness values $K_{ISSC}$ (MPa√m) was determined and was defined as the fracture toughness value $K_{ISSC}$ (MPa√m) of the steel pipe of the test number.

$$K_{1SSC} = \frac{Pa\left(2\sqrt{3} + 2.38^{h/a}\right)\left(B/Bn\right)^{1/\sqrt{3}}}{Bh^{3/2}} \quad (1)$$

Note that in Formula (1), h (mm) represents a height of each arm of the DCB test specimen, B (mm) represents a thickness of the DCB test specimen, and Bn (mm) represents a web thickness of the DCB test specimen. These are defined in "Method D" of NACE TM0177-2005.

[Test Results]

The test results are shown in Table 2.

Referring to Table 1 and Table 2, the chemical composition of the respective steel pipes of Test Numbers 1-1 to 1-9 was appropriate, the number density of BN was within the range of 10 to 100 particles/100 $m^2$, and the yield strength was within the range of 758 to less than 862 MPa. As a result, although the prior-γ grain diameter was within the range of 15 to 30 μm, in the SSC resistance test the fracture toughness value $K_{ISSC}$ (MPa√m) was 29.0 or more, and thus excellent SSC resistance was exhibited.

In contrast, for the steel pipe of Test Number 1-10, the first cooling time period was too short. In addition, the rapid cooling starting temperature was too high. Therefore, the number density of BN was less than 10 particles/100 $m^2$. As a result, in the SSC resistance test, the fracture toughness value $K_{ISSC}$ (MPa√m) was less than 29.0 and excellent SSC resistance was not exhibited.

For the steel pipe of Test Number 1-11, the first cooling time period was too long. Therefore, the number density of BN was more than 100 particles/100 $\mu m^2$. As a result, in the SSC resistance test, the fracture toughness value $K_{ISSC}$ (MPa√m) was less than 29.0 and excellent SSC resistance was not exhibited.

In the steel pipe of Test Number 1-12, the Cr content was too high. As a result, in the SSC resistance test, the fracture toughness value $K_{ISSC}$ (MPa√m) was less than 29.0 and excellent SSC resistance was not exhibited.

In the steel pipe of Test Number 1-13, the Mo content was too high. As a result, in the SSC resistance test, the fracture toughness value $K_{ISSC}$ (MPa√m) was less than 29.0 and excellent SSC resistance was not exhibited.

Example 2

In Example 2, in a case where the yield strength of the steel material is 862 MPa or more (125 ksi or more), the SSC resistance was investigated. Specifically, using Steels A to M having the chemical composition described in Table 1 in Example 1, the SSC resistance of the steel material having the yield strength of 862 MPa or more was investigated.

In a similar manner to Example 1, the molten steels of Steels A to M were refined using the RH (Ruhrstahl-Hausen) method, and thereafter billets of Test Numbers 2-1 to 2-13 were produced by a continuous casting process. The thus-produced billets were held at 1250° C. for one hour, and thereafter was subjected to hot rolling (hot working) by the Mannesmann-mandrel process to produce a hollow shell (seamless steel pipe). The hollow shells of Test Numbers 2-1 to 2-13 after hot rolling were air-cooled such that the hollow shells have a normal temperature (25° C.).

In a similar manner to Example 1, after being allowed to cool, the hollow shells of Test Numbers 2-1 to 2-13 were heated and held for 20 minutes at the quenching temperature (° C.) shown in Table 3. Here, the temperature of the furnace in which reheating was performed was taken as the quenching temperature (° C.). After the hollow shells of Test Numbers 2-1 to 2-13 were allowed to cool after reheating, water-cooling was performed by means of water-cooling equipment. The time period from when the hollow shells of Test Numbers 2-1 to 2-13 that underwent reheating were taken out from the furnace until the time of entering the water-cooling equipment is shown in Table 3 as "first cooling time period (seconds)". The surface temperatures of the hollow shells of Test Numbers 2-1 to 2-13 that were measured by a radiation thermometer installed on the entrance side of the water-cooling equipment are shown in Table 3 as "rapid cooling starting temperature (° C.)". Note that, the $A_{c3}$ points of the hollow shells of Test Numbers 2-1 to 2-13 were all within the range of 850 to 870° C., and the $A_{r3}$ points of the hollow shells of Test Numbers 2-1 to 2-13 were all within the range of 650 to 700° C.

TABLE 3

| Test Number | Steel | Quenching process: Quenching temperature (° C.) | Quenching process: First cooling time period (seconds) | Quenching process: Rapid cooling starting temperature (° C.) | Tempering temperature (° C.) | Prior-γ grain diameter (μm) | BN number density (particles/100 μm²) | YS (MPa) | TS (MPa) | $K_{1SSC}$ (MPa√m) 1 | 2 | 3 | Average value |
|---|---|---|---|---|---|---|---|---|---|---|---|---|---|
| 2-1 | A | 900 | 85 | 800 | 680 | 25 | 12 | 905 | 973 | 27.5 | 28.0 | 27.0 | 27.5 |
| 2-2 | B | 910 | 100 | 750 | 685 | 20 | 16 | 912 | 980 | 28.5 | 27.5 | 28.0 | 28.0 |
| 2-3 | C | 900 | 110 | 730 | 685 | 15 | 60 | 900 | 973 | 29.0 | 29.0 | 28.5 | 28.8 |
| 2-4 | D | 920 | 100 | 750 | 680 | 20 | 15 | 905 | 980 | 28.0 | 28.1 | 27.5 | 27.9 |
| 2-5 | E | 890 | 60 | 815 | 680 | 17 | 20 | 883 | 960 | 28.0 | 28.0 | 28.0 | 28.0 |
| 2-6 | F | 900 | 90 | 780 | 690 | 20 | 32 | 911 | 980 | 29.0 | 29.0 | 28.0 | 28.7 |
| 2-7 | G | 920 | 120 | 710 | 680 | 20 | 10 | 900 | 977 | 27.5 | 28.0 | 28.0 | 27.8 |
| 2-8 | H | 920 | 60 | 815 | 680 | 20 | 25 | 909 | 995 | 29.5 | 30.0 | 29.5 | 29.7 |
| 2-9 | I | 920 | 80 | 800 | 685 | 18 | 30 | 911 | 993 | 28.5 | 29.5 | 29.5 | 29.2 |
| 2-10 | J | 920 | 20 | 900 | 690 | 20 | 4 | 889 | 975 | 27.5 | 25.3 | 26.0 | 26.3 |
| 2-11 | K | 920 | 360 | 710 | 690 | 15 | 110 | 913 | 985 | 26.5 | 25.5 | 25.0 | 25.7 |
| 2-12 | L | 920 | 90 | 800 | 700 | 15 | 24 | 910 | 985 | 20.5 | 22.5 | 23.5 | 22.2 |
| 2-13 | M | 920 | 90 | 800 | 700 | 20 | 30 | 913 | 990 | 25.5 | 22.5 | 25.0 | 24.3 |

In a similar manner to Example 1, the surface temperatures of the hollow shells of Test Numbers 2-1 to 2-13 that were measured by a radiation thermometer installed on the delivery side of the water-cooling equipment were all less than 100° C. The cooling rate in the second cooling process for the hollow shells of Test Numbers 2-1 to 2-13 were determined based on the rapid cooling starting temperature, the surface temperatures of the hollow shells of Test Numbers 2-1 to 2-13 on the delivery side of the water-cooling equipment, and the time required to move from the entrance side to the delivery side of the water-cooling equipment. The cooling rate in the second cooling process for the hollow shells of Test Numbers 2-1 to 2-13 were all 10° C./sec or more. Therefore, the cooling rate during quenching for Test Numbers 2-1 to 2-13 were each regarded as being 10° C./sec or more (i.e., 600° C./minutes or more). Next, tempering in which the hollow shells of Test Numbers 2-1 to 2-13 was held for 100 minutes at the tempering temperatures shown in Table 3 were performed, to thereby produce a steel pipes (seamless steel pipe) of Test Numbers 2-1 to 2-13. Note that, the tempering temperatures shown in Table 3 were all less than the $A_{c1}$ points of the corresponding steel.

[Evaluation Tests]

In a similar manner to Example 1, the steel pipes of Test Numbers 2-1 to 2-13 after the aforementioned tempering were subjected to microstructure observation, a BN number density measurement test, a tensile test and an SSC resistance evaluation test that are described hereunder.

[Microstructure Observation]

In a similar manner to Example 1, the prior-γ grain diameters of the steel pipes of Test Numbers 2-1 to 2-13 were measured by the method described above. The prior-γ grain diameters (μm) of the steel pipes of Test Numbers 2-1 to 2-13 are shown in Table 3.

[BN Number Density Measurement Test]

In a similar manner to Example 1, for the steel pipes of Test Numbers 2-1 to 2-13, the number densities of BN were measured and calculated by the measurement method described above. The TEM used for measurement was manufactured by JEOL Ltd. (model name JEM-2010), and the acceleration voltage was set to 200 kV. The number densities of BN (particles/100 μm²) for the steel pipes of Test Numbers 2-1 to 2-13 are shown in Table 3.

[Tensile Test]

In a similar manner to Example 1, the yield strengths of the steel pipes of Test Numbers 2-1 to 2-13 were measured by the method described above. Specifically, a tensile test was performed in conformity with ASTM E8/E8M (2013). Round bar test specimens having a parallel portion diameter of 4 mm and a parallel portion length of 35 mm were prepared from the center portion of the wall thickness of the steel pipes of Test Numbers 2-1 to 2-13. The axial direction of the round bar test specimens was parallel to the rolling direction (pipe axis direction) of the steel pipe. A tensile test was performed in the atmosphere at normal temperature (25° C.) using the round bar test specimens of Test Numbers 2-1 to 2-13, and the yield strength (MPa) and the tensile strength (MPa) of the steel pipe of each test number were obtained. Note that, in the present examples, obtained 0.2% offset proof stress in the tensile test was defined as the yield strength for each test number. The largest stress during uniform elongation obtained in the tensile test was defined as the tensile strength for each test number. The obtained yield strengths are shown as "YS (MPa)" and tensile strengths are shown as "TS (MPa)" in Table 3.

[Test to Evaluate SSC Resistance of Steel Material]

The SSC resistance was evaluated by performing a DCB test in conformity with NACE TM0177-2005 Method D, using the steel pipes of Test Numbers 2-1 to 2-13. Specifically, three of the DCB test specimen illustrated in FIG. 2A were taken from a center portion of the wall thickness of the steel pipes of Test Numbers 2-1 to 2-13. The DCB test specimens were taken in a manner such that the longitudinal direction of each DCB test specimen was parallel with the rolling direction (pipe axis direction) of the steel pipe. A wedge illustrated in FIG. 2B was further taken from the steel pipes of Test Numbers 2-1 to 2-13. A thickness t of the wedge was 3.10 mm. The aforementioned wedge was driven into between the arms of the DCB test specimen.

A mixed aqueous solution containing 5.0 mass % of sodium chloride, 2.5 mass % of acetic acid and 0.41 mass % of sodium acetate (NACE solution B) was used as the test solution. The test solution was poured into the test vessel enclosing the DCB test specimen into which the wedge had been driven inside so as to leave a vapor phase portion, and was adopted as the test bath. The amount adopted for the test bath was 1 L per test specimen.

Next, $N_2$ gas was blown into the test bath for three hours to degas the test bath until the dissolved oxygen in the test bath became 20 ppb or less. A mixed gas containing $H_2S$ at 0.3 atm (0.03 MPa) and $CO_2$ at 0.7 atm (0.07 MPa) was blown into the degassed test bath to make the test bath a corrosive environment. The pH of the test bath was adjusted to within the range of 3.5 to 4.0 throughout the immersion period. The inside of the test vessel was maintained at 24±3° C. for 17 days (408 hours) while stirring the test bath. After being held, the DCB test specimen was taken out from the test vessel.

In a similar manner to Example 1, a pin was inserted into a hole formed in the tip of the arms of the DCB test specimen that was taken out and a notch portion was opened with a tensile testing machine, and a wedge releasing stress P was measured. In addition, the notch in the DCB test specimen being immersed in the test bath was released in liquid nitrogen, and a crack propagation length "a" with respect to crack propagation that occurred during immersion was measured. The crack propagation length "a" could be measured visually using vernier calipers. A fracture toughness value $K_{ISSC}$ (MPa√m) was determined using the aforementioned Formula (1) based on the measured wedge releasing stress P and the crack propagation length "a". An arithmetic average value of obtained three fracture toughness values $K_{ISSC}$ (MPa√m) was determined and was defined as the fracture toughness value $K_{ISSC}$ (MPa√m) of the steel pipe of the test number.

[Test Results]

The test results are shown in Table 3.

Referring to Table 1 and Table 3, the chemical composition of the respective steel pipes of Test Numbers 2-1 to 2-9 was appropriate, the number density of BN was within the range of 10 to 100 particles/100 $\mu m^2$, and the yield strength was 862 MPa or more. As a result, although the prior-γ grain diameter was within the range of 15 to 30 μm, in the SSC resistance test the fracture toughness value $K_{ISSC}$ (MPa√m) was 27.0 or more, and thus excellent SSC resistance was exhibited.

In contrast, for the steel pipe of Test Number 2-10, the first cooling time period was too short. In addition, the rapid cooling starting temperature was too high. Therefore, the number density of BN was less than 10 particles/100 $\mu m^2$. As a result, in the SSC resistance test, the fracture toughness value $K_{ISSC}$ (MPa√m) was less than 27.0 and excellent SSC resistance was not exhibited.

For the steel pipe of Test Number 2-11, the first cooling time period was too long. Therefore, the number density of BN was more than 100 particles/100 $\mu m^2$. As a result, in the SSC resistance test, the fracture toughness value $K_{ISSC}$ (MPa√m) was less than 27.0 and excellent SSC resistance was not exhibited.

In the steel pipe of Test Number 2-12, the Cr content was too high. As a result, in the SSC resistance test, the fracture toughness value $K_{ISSC}$ (MPa√m) was less than 27.0 and excellent SSC resistance was not exhibited.

In the steel pipe of Test Number 2-13, the Mo content was too high. As a result, in the SSC resistance test, the fracture toughness value $K_{ISSC}$ (MPa√m) was less than 27.0 and excellent SSC resistance was not exhibited.

An embodiment of the present invention has been described above. However, the embodiment described above is merely an example for implementing the present invention. Accordingly, the present invention is not limited to the above embodiment, and the above embodiment can be appropriately modified and performed within a range that does not deviate from the gist of the present invention.

INDUSTRIAL APPLICABILITY

The steel material according to the present invention is widely applicable to steel materials to be utilized in a severe environment such as a polar region, and preferably can be utilized as a steel material that is utilized in an oil well environment, and further preferably can be utilized as a steel material for casing pipes, tubing pipes or line pipes or the like.

The invention claimed is:

1. A steel material having:

a chemical composition consisting of, in mass %,

C: 0.15 to 0.45%,
Si: 0.05 to 1.00%,
Mn: 0.01 to 1.00%,
P: 0.030% or less,
S: 0.0050% or less,
Al: 0.005 to 0.100%,
Cr: 0.60 to 1.80%,
Mo: 0.80 to 2.30%,
Ti: 0.002 to 0.020%,
V: 0.05 to 0.30%,
Nb: 0.002 to 0.100%,
B: 0.0005 to 0.0040%,
Cu: 0.01 to 0.50%,
Ni: 0.01 to 0.50%,
N: 0.0020 to 0.0100%,
O: 0.0020% or less,
Ca: 0 to 0.0100%,
Mg: 0 to 0.0100%,
Zr: 0 to 0.0100%,
rare earth metal: 0 to 0.0100%,
Co: 0 to 0.50%, and
W: 0 to 0.50%, with the balance being Fe and impurities, wherein in the steel material, a number density of BN is within a range of 10 to 100 particles/100 $\mu m^2$, and a yield strength is 758 MPa or more.

2. The steel material according to claim 1, wherein the chemical composition contains one or more elements selected from the group consisting of:

Ca: 0.0001 to 0.0100%,
Mg: 0.0001 to 0.0100%,
Zr: 0.0001 to 0.0100%, and
rare earth metal: 0.0001 to 0.0100%.

3. The steel material according to claim 1 wherein the chemical composition contains one or more elements selected from the group consisting of:

Co: 0.02 to 0.50%, and
W: 0.02 to 0.50%.

4. The steel material according to claim 2, wherein the chemical composition contains one or more elements selected from the group consisting of:

Co: 0.02 to 0.50%, and
W: 0.02 to 0.50%.

5. The steel material according to claim 1, wherein the steel material is an oil-well steel pipe.

6. A method for producing the steel material according to claim 1, comprising:

a preparation process of preparing an intermediate steel material having a chemical composition consisting of, in mass %, C: 0.15 to 0.45%, Si: 0.05 to 1.00%, Mn: 0.01 to 1.00%, P: 0.030% or less, S: 0.0050% or less, Al: 0.005 to 0.100%, Cr 0.60 to 1.80%, Mo: 0.80 to 2.30%, Ti: 0.002 to 0.020%, V: 0.05 to 0.30%, Nb: 0.002 to 0.100%, B: 0.0005 to 0.0040%, Cu: 0.01 to 0.50%, Ni: 0.01 to 0.50%, N: 0.0020 to 0.0100%, O: 0.0020% or less, Ca: 0 to 0.0100%, Mg: 0 to 0.0100%, Zr: 0 to 0.0100%, rare earth metal: 0 to 0.0100%, Co: 0 to 0.50%, and W: 0 to 0.50%, with the balance being Fe and impurities;

a quenching process of, after the preparation process, heating the intermediate steel material to a quenching temperature of 880 to 1000° C., thereafter cooling from the quenching temperature to a rapid cooling starting temperature within a range of an $A_{r3}$ point of the steel material to an $A_{c3}$ point of the steel material −10° C. for 60 to 300 seconds, and thereafter cooling from the rapid cooling starting temperature at a cooling rate of 50° C./min or more; and a tempering process of, after the quenching process, holding the intermediate steel material at a temperature of 620 to 720° C. for 10 to 180 minutes.

7. The method for producing a steel material according to claim 6, wherein the preparation process includes:

a starting material preparation process of preparing a starting material having a chemical composition according to claim 1, and a hot working process of subjecting the starting material to hot working to produce the intermediate steel material.

* * * * *